US008833891B2

(12) United States Patent
Ito et al.

(10) Patent No.: US 8,833,891 B2
(45) Date of Patent: Sep. 16, 2014

(54) IMAGE FORMING APPARATUS AND CONTROL METHOD

(75) Inventors: Takayuki Ito, Kanagawa (JP); Naoki Nakano, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 53 days.

(21) Appl. No.: 13/637,853

(22) PCT Filed: Mar. 30, 2011

(86) PCT No.: PCT/JP2011/058673
§ 371 (c)(1),
(2), (4) Date: Sep. 27, 2012

(87) PCT Pub. No.: WO2011/122711
PCT Pub. Date: Oct. 6, 2011

(65) Prior Publication Data

US 2013/0194333 A1 Aug. 1, 2013

(30) Foreign Application Priority Data

Mar. 30, 2010 (JP) ..... 2010-078825

(51) Int. Cl.
*B41J 2/01* (2006.01)
*B41J 19/14* (2006.01)

(52) U.S. Cl.
CPC . *B41J 2/01* (2013.01); *B41J 19/147* (2013.01)
USPC ..... 347/12

(58) Field of Classification Search
CPC ..... B41J 2/01; B41J 2/04541; B41J 2/04543; B41J 2/04573; B41J 2/04581; B41J 2/04588; B41J 2/0458; B41J 2/15; B41J 2/2103; B41J 2/2107; B41J 2/2132; B41J 11/42; B41J 19/147; B41J 29/38; B41J 29/393
USPC ..... 347/5–20, 40–43
See application file for complete search history.

(56) References Cited

U.S. PATENT DOCUMENTS 6,607,261 B1 8/2003 Shimada
2002/0163550 A1* 11/2002 Otsuki ..... 347/15

(Continued)

FOREIGN PATENT DOCUMENTS

EP 1 024 010 A2 8/2000
EP 1048472 A1 11/2000

(Continued)

OTHER PUBLICATIONS

International Search Report issued Jun. 14, 2011 in PCT/JP2011/058673 filed Mar. 30, 2011.

(Continued)

*Primary Examiner* — Manish S Shah
*Assistant Examiner* — Roger W Pisha, II
(74) *Attorney, Agent, or Firm* — Oblon, Spivak, McClelland, Maier & Neustadt, L.L.P.

(57) ABSTRACT

An image forming apparatus includes: a recording head having a first nozzle row and a second nozzle row. One nozzles of the nozzles in a k-th nozzle group ($1 \leq k \leq p-1$; p is the number of types of droplets) in the conveying direction and of the first nozzle row and second nozzle row ejects the specific type of droplets, and the other nozzles in a k-th nozzle group ejects droplets other than the specific types of droplets. The control unit controls to eject, in one of directions of the reciprocal movement, droplets other than the specific types of droplets from nozzle groups that do not eject the specific type of droplets and the specific type of droplets from the first and second nozzle groups that eject the specific type of droplets and in other one of the directions of the reciprocal movement, droplets other than the specific types of droplets from nozzle groups that do not eject the specific type of droplets.

10 Claims, 27 Drawing Sheets

(56) References Cited

U.S. PATENT DOCUMENTS

| | | | | |
|---|---|---|---|---|
| 2002/0175971 | A1* | 11/2002 | Otsuki | 347/43 |
| 2003/0142168 | A1* | 7/2003 | Suzuki et al. | 347/43 |
| 2004/0032454 | A1 | 2/2004 | Kanda | |
| 2004/0207685 | A1* | 10/2004 | Otsuki | 347/40 |
| 2005/0179725 | A1* | 8/2005 | Matsushima | 347/40 |
| 2005/0237352 | A1* | 10/2005 | Yoneyama | 347/9 |
| 2009/0018881 | A1 | 1/2009 | Ito et al. | |
| 2009/0179934 | A1 | 7/2009 | Takagi et al. | |
| 2009/0244137 | A1* | 10/2009 | Kakutani | 347/12 |

FOREIGN PATENT DOCUMENTS

| | | | |
|---|---|---|---|
| JP | 07-025037 | | 1/1995 |
| JP | 07-112534 | | 5/1995 |
| JP | 08-295034 | | 11/1996 |
| JP | 2001-171151 | | 6/2001 |
| JP | 2003-054016 | A | 2/2003 |
| JP | 2003-246047 | A | 9/2003 |
| JP | 2003-3246047 | A | 9/2003 |
| JP | 2004-106392 | | 4/2004 |
| JP | 2005-305959 | | 11/2005 |
| JP | 4144852 | | 6/2008 |

OTHER PUBLICATIONS

Office Action (with English translation) issued on Apr. 14, 2014, in counterpart Chinese Appln No. 201180017102.9 (15 pages).

* cited by examiner

IMAGE FORMING APPARATUS AND CONTROL METHOD

TECHNICAL FIELD

The present invention relates to an image forming apparatus and a control method.

BACKGROUND ART

Personal computers and workstations have been widespread as image processing apparatuses that process image data. Application software that runs on the above image processing apparatuses forms image data formed of various objects (character, painting, line, and photograph).

There exists printers, facsimile machines, copiers, and multifunction peripherals having functions of the printers, the facsimile machines, and the copiers, as image forming apparatuses that form and output an image of the image data. As for an image forming method, there exists for example an inkjet recording method and electrophotography, and form an image by using image forming material such as recording liquid (ink) or toner.

Among the above image forming apparatuses, apparatuses that perform digital image recording by using the inkjet system is increasingly developed and becoming popular.

In general, an inkjet recording apparatus includes a recording means (print head), a carriage for mounting an ink tank, a conveying means for conveying a recording sheet, and a control means for controlling these means. In recent years, a so-called serial system is becoming popular as the inkjet recording system.

In the serial system, a print head that ejects ink droplets via a plurality of ejection ports is caused to perform serial scanning in a direction (main-scanning direction) perpendicular to conveying direction of a recording-sheet (sub-scanning direction), and intermittent conveyance is performed by the amount equal to a recording width when recording is not performed.

Color inkjet recording apparatuses form color images by layering ink droplets ejected from print heads for a plurality of colors.

Meanwhile, there has been proposed a so-called bidirectional printing technology for ejecting ink droplets during scanning in forward and backward direction in the main-scanning direction in order to increase image forming speed. Furthermore, many inkjet recording apparatuses have a monochrome printing mode for saving ink. Moreover, there is a demand for decreasing the number of print heads as one way of reducing costs of inkjet recording apparatuses. It is desired to achieve high speed and high image quality while meeting the above three requirements. Problems in achieving high speed and high image quality will be explained below.

High Image Quality in Bidirectional Printing

As a problem specific to bidirectional printing, band unevenness that occurs in the main-scanning direction has been known (hereinafter, referred to as a bidirectional color difference). The bidirectional color difference is a phenomenon that occurs due to a significant color difference caused by change between order of layering of colors during the scanning in the forward direction and order of layering of ink during the scanning in the backward direction.

For example, when red is created, the color is produced by mixing magenta ink and yellow ink. However, when magenta ink is first ejected and then yellow ink is ejected on the magenta ink, magenta-like red is created. When ejection is performed in reverse order, yellowish red is created. That is, firstly-ejected color becomes dominant.

Unlike dye ink that is dissolved in ink, pigment ink or colored-resin-emulsion-containing ink, in which particulate colorant components are dispersed, is greatly affected by the order of layering. Therefore, the above phenomenon is an extremely big problem. The problem with the bidirectional color difference can be solved by unifying the order of layering of ink in both directions.

High Speed in Monochrome Printing

In a serial scanning system, there is a known method for increasing a head width in order to achieve high speed. This allows increase in a double-wide image formation width, so that image formation can be complete at higher speed. With use of this method, it is possible to speed up monochrome printing. More specifically, various methods have been proposed, in which, for example, a long head is provided for specific ink or the number of ejection nozzles for specific ink is increased.

To solve the problem with the high speed and high image quality as described above, Japanese Patent Application Laid-open No. 2004-106392, for example, discloses a technology for disposing a color nozzle in a nozzle row direction and unifying bidirectional landing order of color ink in order to reduce a bidirectional color difference. In the method disclosed in Japanese Patent Application Laid-open No. 2004-106392, speed of black monochrome printing can be increased by providing a black nozzle separately from a color nozzle.

Japanese Patent No. 4144852 discloses a technology for increasing the length of a black nozzle to more than double the length of a color nozzle in order to unify the bidirectional landing order and increase the speed of black monochrome printing.

Japanese Patent Application Laid-open No. 2001-171151 discloses a technology for switching between a head used in a main scanning in a forward direction and a head used in the main scanning in a backward direction in order to unify the bidirectional landing order.

Japanese Patent Application Laid-open No. 2005-305959 discloses a technology for symmetrically disposing color nozzles in the sub-scanning direction in order to unify the bidirectional landing order and to increase the speed of image formation.

However, in the method disclosed in Japanese Patent Application Laid-open No. 2004-106392, there is a problem in that it is difficult to unify the landing order for nozzles including the separately-disposed black nozzle. In the methods disclosed in other Patent Literatures, there is a problem in that a head having a specific structure or a plurality of heads is needed.

The present invention has been made in view of the above, and it is an object of the present invention to provide an image forming apparatus and a control method capable of unifying the landing order in bidirectional printing and increasing the speed of monochrome printing.

DISCLOSURE OF INVENTION

It is an object of the present invention to at least partially solve the problems in the conventional technology.

According to an aspect of the present invention, there is provided an image forming apparatus including: a recording head having a first nozzle row and a second nozzle row that are adjacent to each other in a direction perpendicular to a conveying direction of a recording medium, a plurality of nozzles being arrayed in the conveying direction in each of the first nozzle row and the second nozzle row, each of the nozzles ejecting one of p types of droplets including a predetermined specific type of droplets, the p being an integer equal to or greater than three; a moving unit that relatively reciprocates the recording medium and the recording head in a direction perpendicular to the conveying direction; and a control unit that controls ejection of the p types of droplets from the nozzles, wherein the nozzles in each of the first nozzle row and the second nozzle row are divided into (p−1) nozzle groups in the conveying direction, first nozzles of the nozzles in a k-th nozzle group ($1 \le k \le p-1$) in the conveying direction and in one of the first nozzle row and the second nozzle row ejects the specific type of droplets, and second nozzles of the nozzles in the k-th nozzle group in the conveying direction and in other one of the first nozzle row and the second nozzle row ejects one of the p types of droplets other than the specific type of droplets, nozzles of each of the (p−1) nozzle groups that do not eject the specific type of droplets ejects different one of the p types of droplets other than the specific type of droplets, nozzles of one of the (p−1) nozzle groups ejecting the specific type of droplets at first in the conveying direction and nozzles of other one of the nozzle groups (p−1) ejecting the specific type of droplets at second in the conveying direction belong to different nozzle rows, and the control unit controls to eject, in one of directions of the reciprocal movement, the p types of droplets other than the specific type of droplets from the nozzles of the each of the (p−1) nozzle groups that do not eject the specific type of droplets and to eject the specific type of droplets from the nozzles of the one of the (p−1) nozzle groups ejecting the specific type of droplets at first in the conveying direction and from the nozzles of the other one of the (p−1) nozzle groups ejecting the specific type of droplets at second in the conveying direction, and controls to eject, in other one of the directions of the reciprocal movement, the p types of droplets other than the specific type of droplets from the nozzles of the each of the (p−1) nozzle groups that do not eject the specific type of droplets.

According to another aspect of the present invention, there is provided a control method implemented by an image forming apparatus that includes: a recording head having a first nozzle row and a second nozzle row that are adjacent to each other in a direction perpendicular to a conveying direction of a recording medium, a plurality of nozzles being arrayed in the conveying direction in each of the first nozzle row and the second nozzle row, each of the nozzles ejecting one of p types of droplets including a predetermined specific type of droplets, the p being an integer equal to or greater than three, wherein the nozzles in each of the first nozzle row and the second nozzle row are divided into (p−1) nozzle groups in the conveying direction, first nozzles of the nozzles in k-th nozzle group ($1 \le k \le p-1$) in the conveying direction and in one of the first nozzle row and the second nozzle row ejects the specific type of the droplet, and second nozzles of the nozzles in the k-th nozzle group in the conveying direction and in other one of the first nozzle row and the second nozzle row ejects one of the p types of droplets other than the specific type of droplets, nozzles of each of the (p−1) nozzle groups that do not eject the specific type of droplets ejects different one of the p types of droplets other than the specific type of droplets, nozzles of one of the (p−1) nozzle groups ejecting the specific type of droplets at first in the conveying direction and nozzles of other one of the nozzle groups (p−1) ejecting the specific type of droplets at second in the conveying direction belong to different nozzle rows, the control method including: relatively reciprocating the recording medium and the recording head in a direction perpendicular to the conveying direction; and controlling to eject, in one of directions of the reciprocal movement, the p types of droplets other than the specific type of droplets from the nozzles of the each of the (p−1) nozzle groups that do not eject the specific type of droplets and to eject the specific type of droplets from the nozzles of the one of the (p−1) nozzle groups ejecting the specific type of droplets at first in the conveying direction and from the nozzles of the other one of the (p−1) nozzle groups ejecting the specific type of droplets at second in the conveying direction, and controls to eject, in other one of the directions of the reciprocal movement, the p types of droplets other than the specific type of droplets from the nozzles of the each of the (p−1) nozzle groups that do not eject the specific type of droplets.

BEST MODE(S) FOR CARRYING OUT THE INVENTION

Exemplary embodiments of an image forming apparatus and a control method according to the present invention will be described in detail below with reference to the accompanying drawings.

First Embodiment

An image forming apparatus according to a first embodiment is applied to what is called a serial-type inkjet recording system, and implements functions described below.

(1) Unification of Landing Order of Ink at the Time of Bidirectional Printing

Landing order of ink is unified by disposition of nozzles and a print head moving and conveying operation. When color printing is performed, a black nozzle is driven with one-way scanning and a color nozzle is driven with two-way scanning. The conveying amount is set to be equal to a width of the color nozzle that has been driven, so that an image can be formed by performing scanning at least three times.

(2) High-Speed Monochrome Printing

A print head has one nozzle group with a width at least three times greater than that of color nozzles. A print mode using this nozzle group only is provided, so that monochrome printing can be performed at speed about three times faster than the speed of image formation using the nozzles for all colors.

(3) Simple Head and Nozzle Structure

The print head has two or more nozzle rows, and at least two nozzle groups arranged in the nozzle row direction. This enables to handle a case in which there is a nozzle that cannot be used for different colorants because of the layout of colorant supply paths communicating with nozzle holes.

Figure 1:
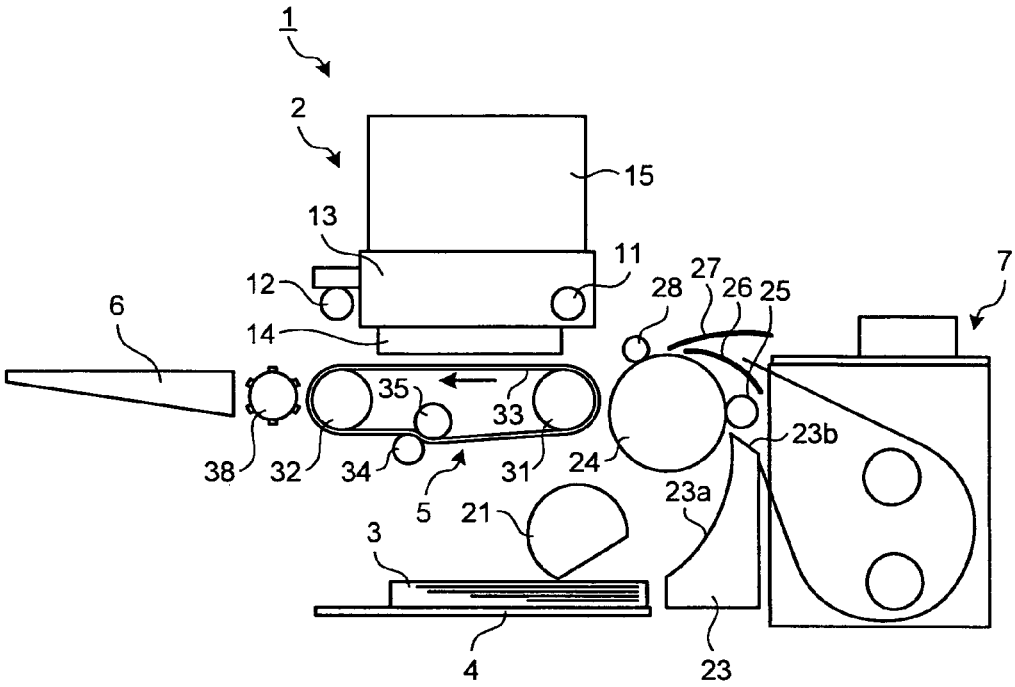
FIG. 1 is a schematic configuration diagram of a whole mechanical unit of an inkjet recording apparatus.
Figure 2:
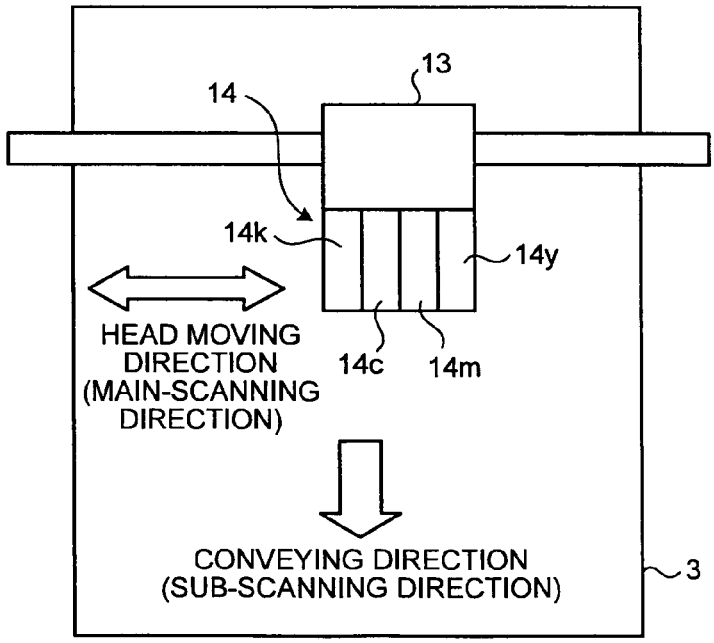
FIG. 2 is a plan view for explaining main parts of the inkjet recording apparatus.
Figure 3:
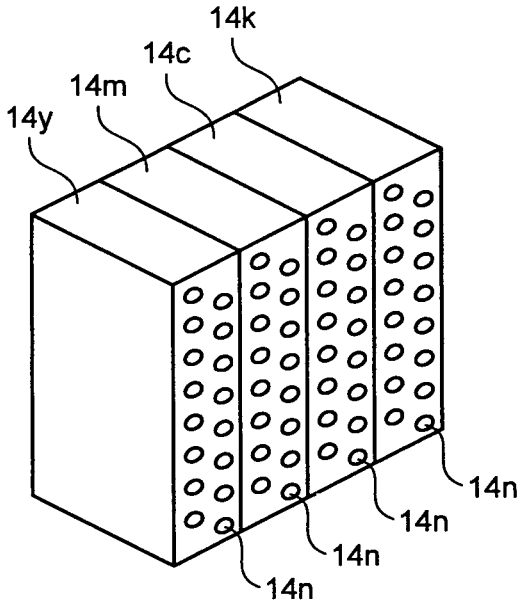
FIG. 3 is a perspective view for explaining a head structure of the inkjet recording apparatus.
Figure 4:
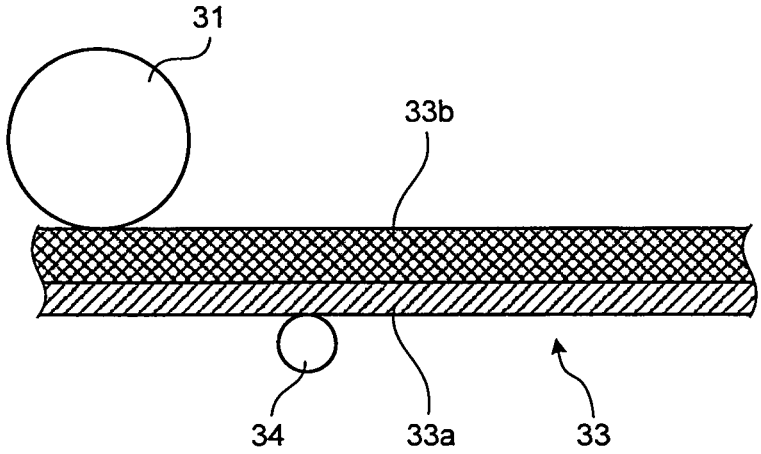
FIG. 4 is a schematic cross-sectional view for explaining a conveying belt of the inkjet recording apparatus.

An example of an inkjet recording apparatus as the image forming apparatus of the first embodiment will be described below with reference to FIGS. 1 to 4. FIG. 1 is a schematic configuration diagram of a whole mechanical unit of the inkjet recording apparatus. FIG. 2 is a plan view for explaining main parts of the inkjet recording apparatus. FIG. 3 is a perspective view for explaining a head structure of the inkjet recording apparatus. FIG. 4 is a schematic cross-sectional view for explaining a conveying belt of the inkjet recording apparatus.

An inkjet recording apparatus 1 includes an image forming unit 2 or the like inside an apparatus body and includes a feed tray 4 that can stack a plurality of recording media (hereinafter, referred to as "sheets") 3 on the lower side of the apparatus body. The inkjet recording apparatus 1 picks up the sheet 3 fed from the feed tray 4, causes the image forming unit 2 to record a necessary image while conveying the sheet 3 by a conveying mechanism 5, and discharges the sheet 3 to a discharge tray 6 attached to a lateral side of the apparatus body.

The inkjet recording apparatus 1 further includes a duplex unit 7 that is detachably attached to the apparatus body. When performing duplex printing, the inkjet recording apparatus 1 takes the sheet 3 in the duplex unit 7 while conveying the sheet 3 in a reverse direction by the conveying mechanism 5 after printing on one side (top side) is complete, reverses the sheet 3, re-feeds the sheet 3 with other surface (back side) up as a printing surface to the conveying mechanism 5, performs printing on the other surface (back side), and discharges the sheet 3 to the discharge tray 6.

In the image forming unit 2, a carriage 13 is slidably supported by guide shafts 11 and 12, and is moved by a main-scanning motor (not illustrated) in a direction perpendicular to a conveying direction of the sheet 3 (main scanning). A recording head 14 formed of droplet ejection heads having a plurality of nozzle holes 14*n* (see FIG. 3) as ejection ports for ejecting droplets is mounted on the carriage 13. An ink cartridge 15 for supplying liquid to the recording head 14 is detachably mounted on the carriage 13. It is possible to mount a sub tank instead of the ink cartridge 15 and replenish and supply ink to the sub tank from a main tank.

As illustrated in FIGS. 2 and 3, the recording head 14 is formed of, for example, four independent recording heads 14*y*, 14*m*, 14*c*, and 14*k*, which are droplet ejection heads for ejecting ink droplets of respective colors, i.e., yellow (Y), magenta (M), cyan (C), and black (K). However, the recording head may be structured such that one or more heads having a plurality of nozzle rows for ejecting ink droplets of different colors are used. The number of colors and order of arrangement are not limited to this example.

An inkjet head constituting the recording head 14 may include, as an energy generating means, a piezoelectric actuator, such as a piezoelectric element, a thermal actuator that utilizes phase-change caused by liquid film boiling with the aid of an electro-thermal conversion element such as a heat resistive element, a shape-memory alloy actuator that utilizes metallic phase-change caused by temperature change, and an electrostatic actuator that utilizes electrostatic force.

As the electro-thermal conversion element, an electro-thermal conversion element having nonlinear characteristics, in which a resistance value is less likely to change when a low voltage is applied but the resistance value greatly changes when a voltage equal to or greater than a predetermined value is applied.

In an electro-thermal conversion element having linear characteristics, when a plurality of heating means is selectively driven, a noise voltage is applied to an unselected heating means. Accordingly, energy may be wasted or a driving voltage may be disturbed, so that an ejection amount of ink may be changed. As a result, a recorded image may be disturbed. In particular, in an inkjet recording head that applies a voltage to a plurality of vertical wirings and a plurality of horizontal wirings in order to selectively drive heating means that are arranged in a matrix manner at intersections of the vertical wirings and the horizontal wirings, a voltage lower than a driving voltage may be applied to an unselected heating means during driving. If this voltage is a forward voltage, the unselected heating means generates unnecessary heat. When the unnecessary heat is generated and accumulated, and if the heating means is heated for ejection, the heating means generates heat in excess of a specified value, so that more amount of ink than is necessary is ejected. Therefore, the ink ejection amount may vary between nozzles.

By contrast, with use of the electro-thermal conversion element having nonlinear characteristics, unnecessary heat is not generated even when a voltage, such as noise, lower than a driving voltage is applied to a heating means, so that variation in the ink ejection amount can be suppressed and good granularity and tone of a printed object can be ensured. Besides, because unnecessary heat can be prevented, energy wasting can be prevented.

Further, it is possible to measure a resistance value of each electro-thermal conversion element of the recording head, and adjust a driving voltage to be applied to each electro-thermal conversion element based on the resistance value. In particular, when the length of the recording head is increased, the resistance value of an electro-thermal conversion element of each nozzle is more likely to vary, and therefore, the amount of ejected ink varies. However, by adjusting an application voltage by feeding back the resistance value of each electro-thermal conversion element, it is possible to eject ink droplets of a desired size.

When a thermal-type recording head is used, a protective layer may be arranged on an electro-thermal conversion element (ejection energy generator). With the protective layer, the electro-thermal conversion element is not directly influenced by corrosion due to ink, kogation (ink component gets burned), or cavitation (collapse due to shock when bubbles are constricted). Therefore, the electro-thermal conversion element is not damaged, so that the lifetime of the electro-thermal conversion element can be lengthened.

The sheets 3 in the feed tray 4 are separated one by one by a feed roller (semilunar roller) 21 and a separation pad (not illustrated), fed to the inside of the apparatus body, and delivered to the conveying mechanism 5.

The conveying mechanism 5 includes: a conveyance guide unit 23 that guides the fed sheet 3 to an upper side along a guide surface 23*a* and guides the sheet 3 delivered from the duplex unit 7 along a guide surface 23*b*; a conveying roller 24 that conveys the sheet 3; a pressing roller 25 that presses the sheet 3 toward the conveying roller 24; a guide member 26 that guides the sheet 3 toward the conveying roller 24; a guide member 27 that guides the sheet 3, which has been returned for duplex printing, to the duplex unit 7; and a pressing roller 28 that presses the sheet 3 to be fed from the conveying roller 24.

The conveying mechanism 5 further includes, to convey the sheet 3 while maintaining the flatness of the sheet 3 with the aid of the recording head 14, a conveying belt 33 extended between a driving roller 31 and a driven roller 32; a charging roller 34 that charges the conveying belt 33; a guide roller 35 opposed to the charging roller 34; a guide member (platen plate) (not illustrated) that guides the conveying belt 33 at a position facing the image forming unit 2; and a cleaning roller made of porous body and serving as a cleaning means for removing recording liquid (ink) adhered to the conveying belt 33.

The conveying belt 33 is an endless belt extended between the driving roller 31 and the driven roller (tension roller) 32 and is structured to rotate in a direction of the arrow (sheet conveying direction) illustrated in FIG. 1.

The conveying belt 33 may have a single-layer structure, a double-layer structure formed of a first layer (topmost layer) 33*a* and a second layer (back layer) 33*b* as illustrated in FIG. 4, or three or more layer structures. For example, the conveying belt 33 is formed of a top layer that functions as a sheet adhesion surface and that is made of pure resin material, e.g., ethylene tetrafluoroethylene (ETFE) pure material, without resistance control and with a thickness of 40 μm, and a back layer (medium-resistivity layer, ground layer) that is made of the same material as that of the top layer with resistance control by carbon.

The charging roller 34 is arranged so as to come into contact with the top layer of the conveying belt 33 and rotate along with the rotation of the conveying belt 33. A high-voltage circuit (high-voltage power supply) (not illustrated) applies a high voltage in a predetermined pattern to the charging roller 34.

A discharge roller 38 that discharges the sheet 3 carrying a recorded image to the discharge tray 6 is arranged on a downstream side of the conveying mechanism 5.

In the inkjet recording apparatus 1 configured as above, the conveying belt 33 rotates in the direction of the arrow, and is positively charged by coming into contact with the charging roller 34 to which a high-potential voltage is being applied. In this case, polarity of charges applied by the charging roller 34 is changed at predetermined time intervals, so that the conveying belt 33 is charged at a predetermined charging pitch.

When the sheet 3 is fed onto the conveying belt 33 being charged to a high potential, interior of the sheet 3 is polarized, and charges with polarity opposite to that of charges on the conveying belt 33 are induced on a contact surface between the sheet 3 and the conveying belt 33. Accordingly, the charges on the conveying belt 33 and the charges induced on the sheet 3 being conveyed electrostatically attract each other, so that the sheet 3 electrostatically adheres to the conveying belt 33. Therefore, warpage and irregularities are corrected in the sheet 3 strongly adhering to the conveying belt 33, so that a highly flat surface can be obtained.

Figure 5:
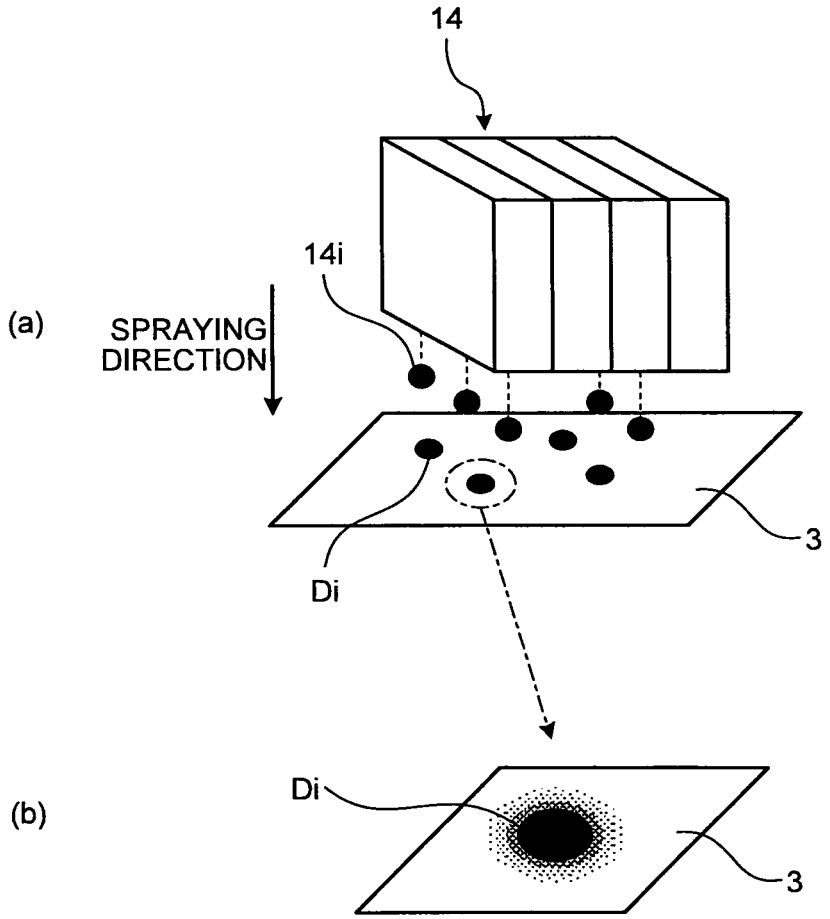
FIG. 5 is a diagram for explaining a recording operation performed by the inkjet recording apparatus.

Then, the conveying belt 33 is rotated to move the sheet 3, and the recording head 14 is driven according to an image signal while the carriage 13 is moved for scanning in a one-way direction or a both-way direction. Accordingly, as illustrated in FIGS. 5(*a*) and (*b*), the recording head 14 is caused to eject (spray) liquid droplets 14*i* such that ink droplets being liquid droplets land onto the sheet 3 being stopped, whereby dots Di are formed and recording for one line is complete. Subsequently, the sheet 3 is conveyed a predetermined distance, and next recording is performed. When a recording end signal or a signal indicating that a trailing end of the sheet 3 has reached a recording region is received, a recording operation is ended. A dot Di portion illustrated in FIG. 5(*a*) is enlarged in FIG. 5(*b*).

In this manner, the sheet 3 carrying a recorded image is discharged to the discharge tray 6 by the discharge roller 38.

Figure 6:
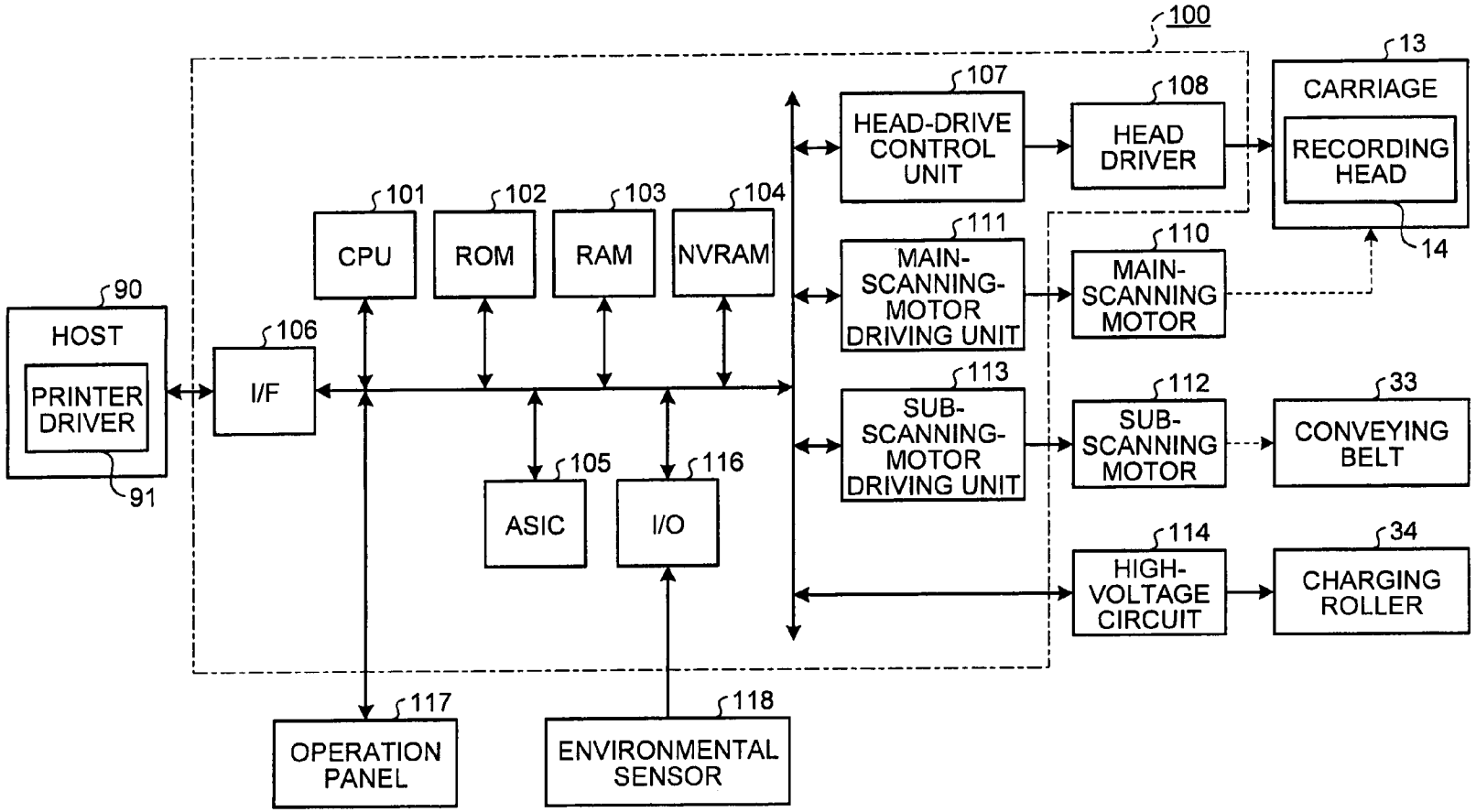
FIG. 6 is a block diagram of a whole control unit.

An overview of a control unit of the inkjet recording apparatus 1 will be described below with reference to FIG. 6. FIG. 6 is a block diagram of a whole control unit. A control unit 100 includes: a central processing unit (CPU) 101 that controls the whole inkjet recording apparatus 1; a read only memory (ROM) 102 for storing computer programs to be executed by the CPU 101 and other fixed data; a random access memory (RAM) 103 for temporarily storing image data or the like; a nonvolatile memory (NVRAM) 104 for storing data even when power of the apparatus is shut off; and an application specific integrated circuit (ASIC) 105 that performs various types of signal processing, image processing for sorting or the like, and processing on input signals to control the whole apparatus.

The control unit 100 further includes: an I/F 106 for transmitting and receiving data and signals to and from a host 90 that is a data processing apparatus, such as a personal computer, on which a printer driver according to the present invention is mountable; a head-drive control unit 107 and a head driver 108 that control driving of the recording head 14; a main-scanning-motor driving unit 111 that drives a main-scanning motor 110; a sub-scanning-motor driving unit 113 that drives a sub-scanning motor 112; an environmental sensor 118 that detects environmental temperature and/or environmental humidity; and an I/O 116 for inputting detection signals from various sensors (not illustrated).

The main-scanning-motor driving unit 111 rotates the main-scanning motor 110 based on an instruction from the CPU 101 to thereby move the carriage 13 in a forward direction and a backward direction of the main-scanning direction. The main-scanning-motor driving unit 111 functions as a moving means for relatively reciprocating the sheet 3 (recording medium) and the recording head 14 with each other. The configuration illustrated in FIG. 6 is one example, and any conventionally-known methods for relatively reciprocating the sheet 3 (recording medium) and the recording head 14 with each other may be applied.

An operation panel 117 for inputting and displaying information necessary for the inkjet recording apparatus 1 is connected to the control unit 100. The control unit 100 performs control to switch ON/OFF of a high-voltage circuit (high-voltage power supply) 114 that applies a high voltage to the charging roller 34, and also performs control to change output polarity.

The control unit 100 receives, through the I/F 106, print data including image data from the host 90 via a cable or a network. Examples of the host 90 include a data processing apparatus such as a personal computer, an image reading apparatus such as an image scanner, and an imaging apparatus such as a digital camera. The print data is generated and output to the control unit 100 by a printer driver 91 of the host 90.

The CPU 101 reads and analyzes the print data in a receiving buffer included in the I/F 106, causes the ASIC 105 to perform a data sorting process or the like, and sends image data to the head-drive control unit 107. As described above, the print data for outputting an image is converted into bitmap data in such a manner that the printer driver 91 of the host 90 side loads the image data as the bitmap data and sends the bitmap data to the apparatus. However, the conversion may be performed by storing font data in the ROM 102.

When receiving image data (dot pattern data) corresponding to one line of the recording head 14, the head-drive control unit 107 outputs, as serial data, the dot pattern data for one line to the head driver 108 in synchronization with a clock signal, and also outputs a latch signal to the head driver 108 at predetermined timing.

The head-drive control unit 107 includes a ROM (which may be formed of the ROM 102) for storing pattern data of a drive waveform (drive signal), and a waveform generator circuit that includes a digital to analog (D/A) converter for performing D/A conversion on data of the drive waveform, which is read from the ROM, and a drive-waveform generator circuit formed of an amplifier or the like.

The head driver 108 includes: a shift register that inputs the clock signal and the serial data as the image data, which are sent from the head-drive control unit 107; a latch circuit that latches a register value of the shift register by the latch signal sent from the head-drive control unit 107; a level converting circuit (level shifter) that changes the level of an output value of the latch circuit; and an analog switch array (switching means) of which ON/OFF is controlled by the level converting circuit. The head driver 108 controls ON/OFF of the analog switch array to selectively apply a predetermined drive waveform contained in the drive waveform to an actuator means of the recording head 14, thereby driving the head.

The head-drive control unit 107 and the head driver 108 function as a control means for controlling ejection of droplets from the nozzles.

According to the embodiment, it is possible to perform printing without forming a margin on at least one edge of a printing object.

Even when ink is sprayed so as to perform printing up to the absolute edge of a printing object, it is often difficult to drop ink onto ideal landing positions because of feed error in a printing-object conveying system, drive error in the carriage, or the like. Accordingly, even when printing is performed so as not to form a margin, a margin may be formed in some cases. Therefore, printing is performed on a wider region than an ideal region by taking into account error in printing positions, so that ink is inevitably ejected even onto the outside of the printing object. Because ink on the outside of the printing object does not contribute to recording, the ink is wasted. Therefore, it is desirable to prevent ink from dropping onto the outside of the printing object as much as possible.

As a method for preventing ink from dropping onto the outside of the printing object, for example, a method for improving printing-object conveying accuracy has been known. By improving the conveying accuracy to reduce an expected region onto which ink drops outside the printing object, it is possible to reduce wasting of ink. More specifically, when printing is performed on the edge of a printing object, it may be possible to improve the conveying accuracy by finely feeding the printing object.

Figure 7:
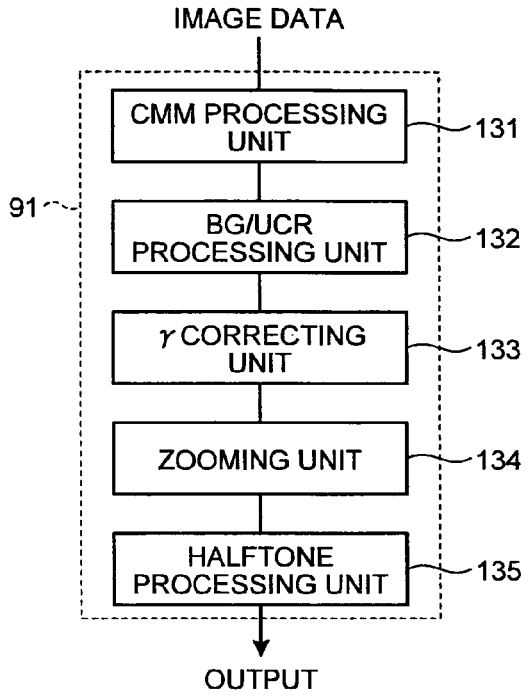
FIG. 7 is a diagram illustrating an example of an image processing apparatus including a printer driver that transfers image data to form an image by the inkjet recording apparatus.

An explanation will be given of, with reference to FIG. 7, an example of an image processing apparatus that includes a printer driver and that serves as a host side for transferring image data in order to form an image by the inkjet recording apparatus 1. The printer driver 91 includes: a CMM (color management module) processing unit 131 that converts a color space for monitor display to a color space for the recording apparatus (RGB color system→CMY color system) for image data provided by application software or the like; an BG/UCR (Black Generation/Under Color Removal) processing unit 132 that performs black generation/under color removal based on a CMY value; a γ correcting unit 133 that performs input-output correction to reflect characteristics of the recording apparatus or user's preference; a zooming unit 134 that performs a zoom process according to resolution of the recording apparatus; and a halftone processing unit 135 having a multi-valued/non-multi-valued matrix for replacing the image data with a pattern array of dots to be ejected from the recording apparatus.

As described above, the first embodiment is applied to what is called a serial-type inkjet recording system (see FIG. 2). That is, a means for driving at least one recording head 14 having a plurality of nozzles for ejecting colorants (the head-drive control unit 107 and the head driver 108), a means for moving the recording head 14 (the main-scanning-motor driving unit 111), and a means for conveying a recording medium (the sub-scanning-motor driving unit 113) are provided.

A detailed explanation will be given of disposition of the nozzles of the recording head 14 according to the first embodiment, head movement control performed by the main-scanning-motor driving unit 111, and conveyance control performed by the sub-scanning-motor driving unit 113. In the following, an example is explained in which four types of colorants in respective colors, i.e., yellow (Y), magenta (M), cyan (C), and black (K), are used. In this example, black (K) is used as a specific type of color (hereinafter, referred to as a specific color) that is determined in advance for use in monochrome printing.

Due to the configuration of the recording head 14, the head movement control, and the conveyance control described below, it becomes possible to unify landing order of ink in bidirectional scanning. Besides, printing in a print mode using only the first colorant can be performed at faster speed than printing in a print mode using a plurality of colorants.

Figure 8:
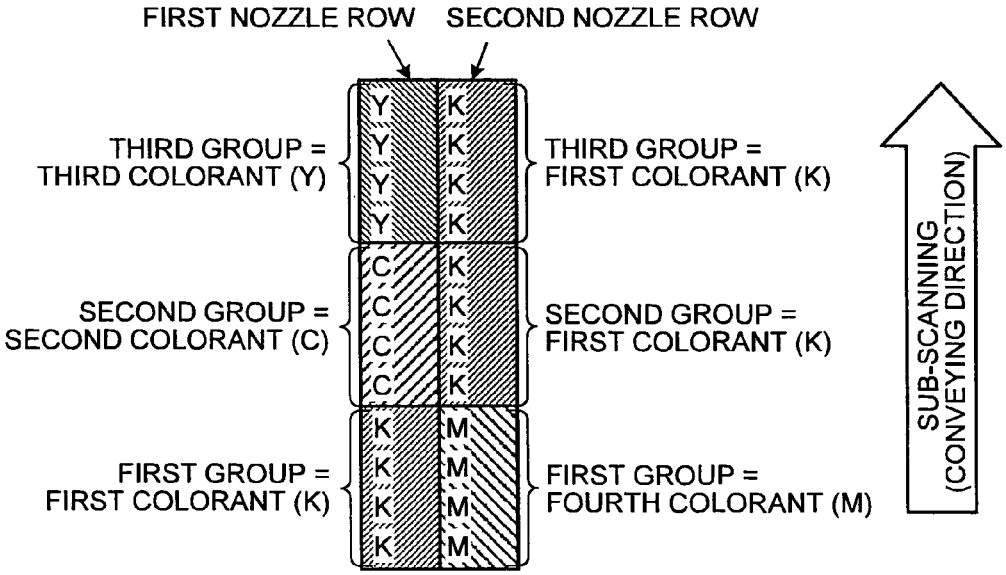
FIG. 8 is a diagram illustrating an example of disposition of nozzles of a recording head according to a first embodiment.

FIG. 8 is a diagram illustrating an example of disposition of the nozzles of the recording head 14 according to the first embodiment. As illustrated in FIG. 8, the recording head 14 has a first nozzle row and a second nozzle row, which are adjacent to each other in a direction perpendicular to a sheet conveying direction. Nozzles contained in each nozzle row are divided into three nozzle groups of the first group to the third group in this order from the upstream side to the downstream side of the conveying direction. The nozzles contained in the same nozzle group eject droplets of the same color.

In the example illustrated in FIG. 8, the first group, the second group, and the third group in the first nozzle row contain nozzles of the first colorant (hereinafter, black (K)), the second colorant (hereinafter, cyan (C)), and the third colorant (hereinafter, yellow (Y)), respectively. Further, in the example illustrated in FIG. 8, the first group, the second group, and the third group in the second nozzle row contain nozzles of the fourth colorant (hereinafter, magenta (M)), the first colorant, and the first colorant, respectively.

In this manner, according to the first embodiment, nozzles in a k-th nozzle group (k is an integer that satisfies $1 \leq k \leq$ (the number of colors−1)) in the conveying direction and in one of the first nozzle row and the second nozzle row ejects droplets of a specific color (black), and nozzles in the k-th nozzle group in the conveying direction and in other one of the first nozzle row and the second nozzle row ejects droplets of a color other than the specific color.

Further, as illustrated in FIG. 8, the number of nozzles contained in each nozzle group is identical (four in FIG. 8). The number of nozzles for the first colorant (K) used in monochrome printing is twelve as a sum of nozzles in the three groups. By equalizing the number of nozzles contained in each nozzle group, all of the nozzles can efficiently be used at the time of image formation.

The head structure illustrated in FIG. 8 is one example, and a head structure described below may also be applied. Specifically, when an image is formed by using p types of colorants (p is an integer equal to or greater than three), the first nozzle row is divided into (p−1) groups such that the first group handles the first colorant and the k-th group handles the k-th colorant (k is an integer that satisfies $2 \leq k \leq (p-1)$), and the second nozzle row is divided into (p−1) groups such that the first group handles the p-th colorant and the second to (p−1)th groups handle the first colorant.

Figure 9:
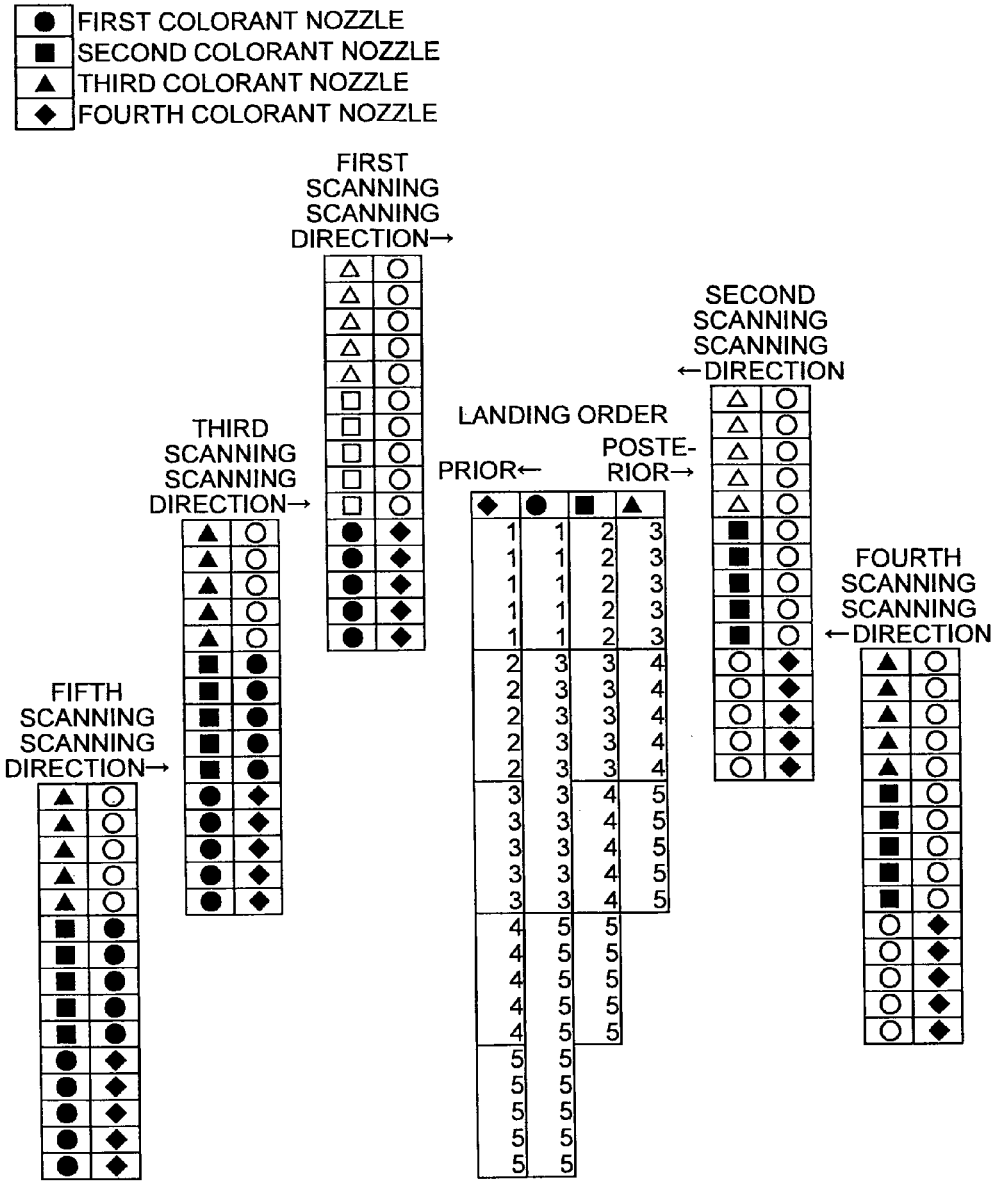
FIG. 9 is a diagram for explaining an overview of control for unifying landing order when an upper end of an image is printed.
Figure 10:
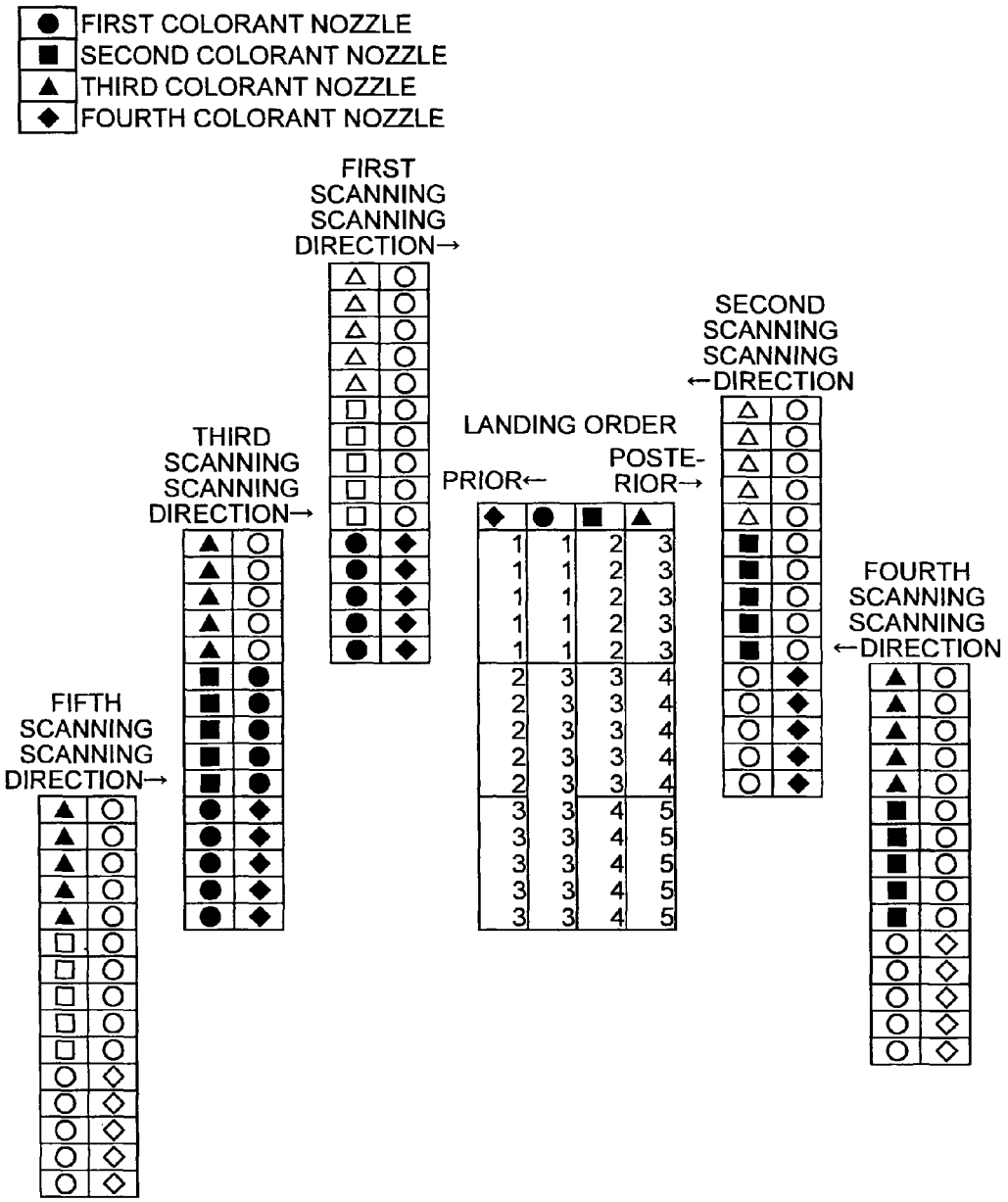
FIG. 10 is a diagram for explaining an overview of control for unifying landing order when a lower end of an image is printed.

An explanation will be given of, with reference to FIGS. 9 and 10, a control method for unifying landing order of ink at the time of bidirectional printing by using the recording head 14 structured as illustrated in FIG. 8. FIG. 9 is a diagram for explaining an overview of control for unifying the landing order when an upper end of an image is printed. FIG. 10 is a diagram for explaining an overview of control for unifying the landing order when a lower end of an image is printed.

In FIGS. 9 and 10, the first colorant nozzle to the fourth colorant nozzle are represented by four symbols, i.e., circle, square with a horizontal base, triangle, and square with an non-horizontal base, respectively. Blacked-out symbols indicate that droplets are ejected, and the other symbols indicate that droplets are not ejected. In FIGS. 9 and 10, the number of nozzles in each nozzle group is set to five.

When printing is started from the upper end of an image, ejection and head movement are controlled as following. In particular, at a first time scanning (first scanning) in the forward direction of the main-scanning direction, ink (the fourth colorant) is ejected from nozzles of the first group in the second nozzle row, and ink (the first colorant) is ejected from nozzles of the first group in the first nozzle row, in this order. Thereafter, the sub-scanning-motor driving unit 113 conveys a sheet in the sub-scanning direction by the amount of five nozzles.

At the scanning in the backward direction of the main-scanning direction (second scanning), ejection and head movement are controlled as in the following. In particular, ink (the second colorant) is ejected from nozzles of the second group in the first nozzle row, and the ink (the fourth colorant) is ejected from the nozzles of the first group in the second nozzle row.

By the same procedure, third scanning, fourth scanning, and fifth scanning illustrated in FIG. 9 are performed. Thereafter, the third scanning, conveyance of the sheet by the amount of five nozzles, and the fourth scanning are repeated until the lower end of the image, whereby an image is formed.

The landing order implemented by the above control is illustrated in the center of FIG. 9. In FIG. 9, the landing order is represented by the numbers indicating the order of scanning. As illustrated in FIG. 9, control is performed so that the fourth colorant, the first colorant, the second colorant, and the third colorant are caused to land in this order along one line in the main-scanning direction.

As illustrated in FIG. 10, when a lower end of an image is printed, ejection and head movement are controlled as in the following. In particular, at the scanning subsequent to the third scanning (i.e., fourth scanning) of FIG. 9, ink (the second colorant) is ejected from nozzles of the second group in the first nozzle row, and ink (the third colorant) is ejected from nozzles of the third group in the first nozzle row, in this order. Thereafter, at the subsequent scanning (i.e., fifth scanning), ejection and head movement are controlled so that ink (the third colorant) is ejected from nozzles of the third group of the first nozzle row.

Figure 11:
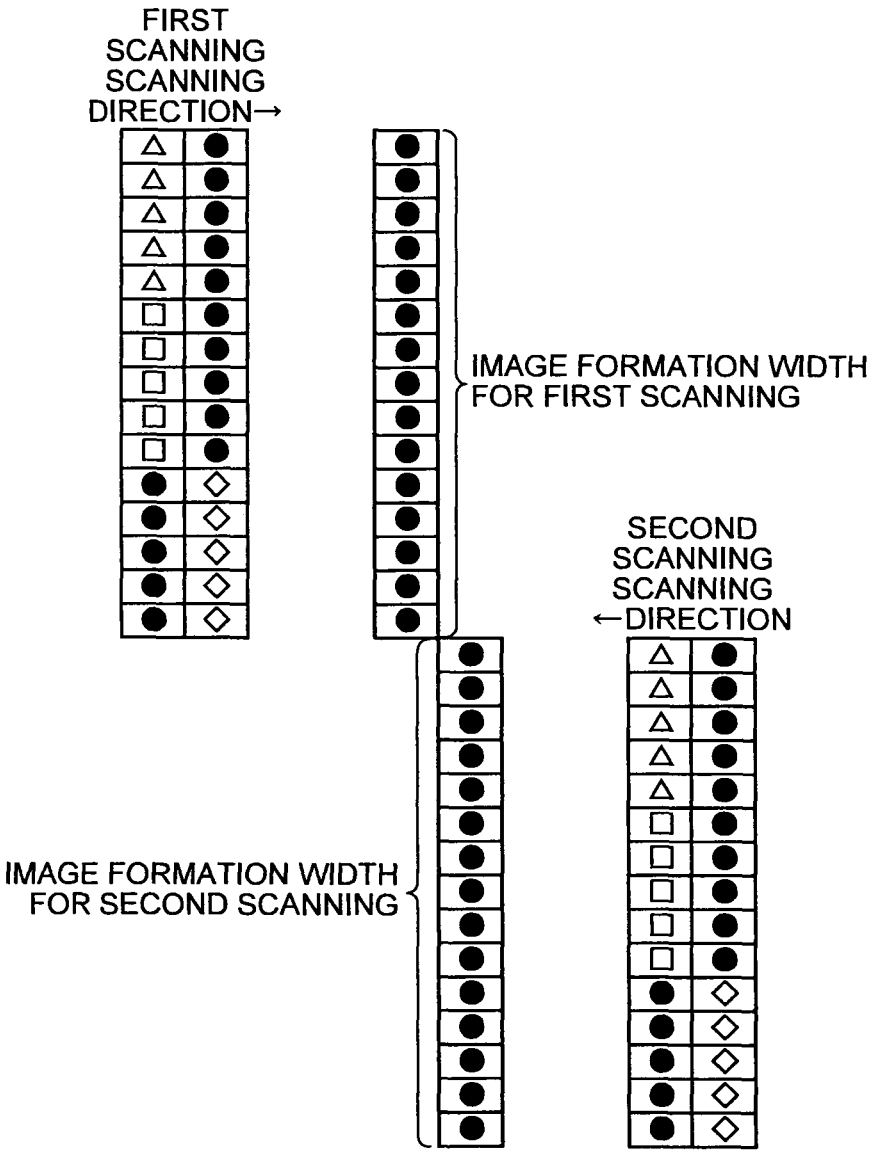
FIG. 11 is a diagram for explaining an overview of control for performing monochrome printing.

A detailed explanation will be given of, with reference to FIG. 11, head movement control and conveyance control performed when black monochrome printing is performed. FIG. 11 is a diagram for explaining an overview of control for performing monochrome printing. As described above with reference to FIG. 8, the number of nozzles for the first colorant (black (K)) is greater than the number of the other colorants. Therefore, the width of an image to be formed by one scanning is large.

Accordingly, when a mode for monochrome printing is specified, the head movement control and the conveyance control are changed. Specifically, in the monochrome printing, control is performed so that ink is ejected from all of the nozzles for the first colorant both in the forward direction and the backward direction of the main-scanning direction. In the image formation using only the first colorant as illustrated in FIG. 11, the double-wide image width corresponds to the number of the nozzles for the first colorant, i.e., fifteen nozzles. By repeating the conveying operation and scanning by the amount of the fifteen nozzles, an image is formed. Therefore, it is possible to increase the speed of image formation in the mode for forming an image using only the first colorant.

First Modification

Figure 12:
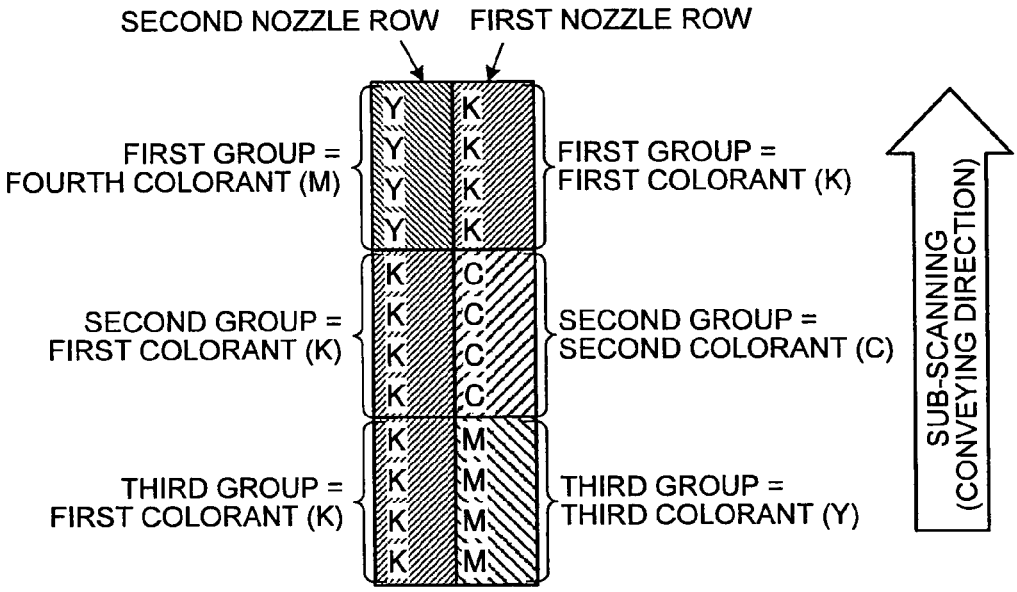
FIG. 12 is a diagram illustrating another example of disposition of nozzles of the recording head.
Figure 13:
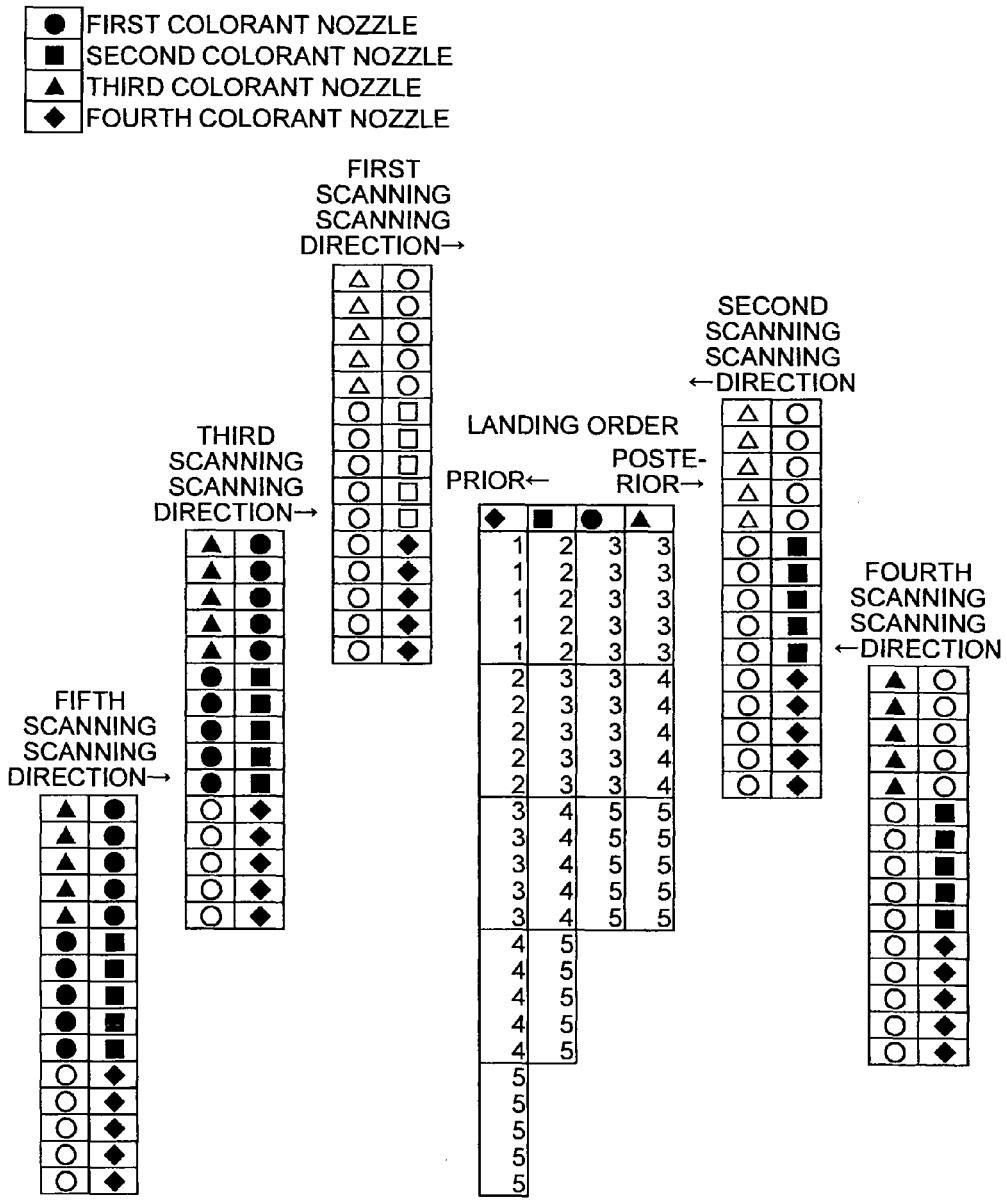
FIG. 13 is a diagram for explaining an overview of control for unifying landing order when an upper end of an image is printed with the head structure illustrated in FIG. 12.
Figure 14:
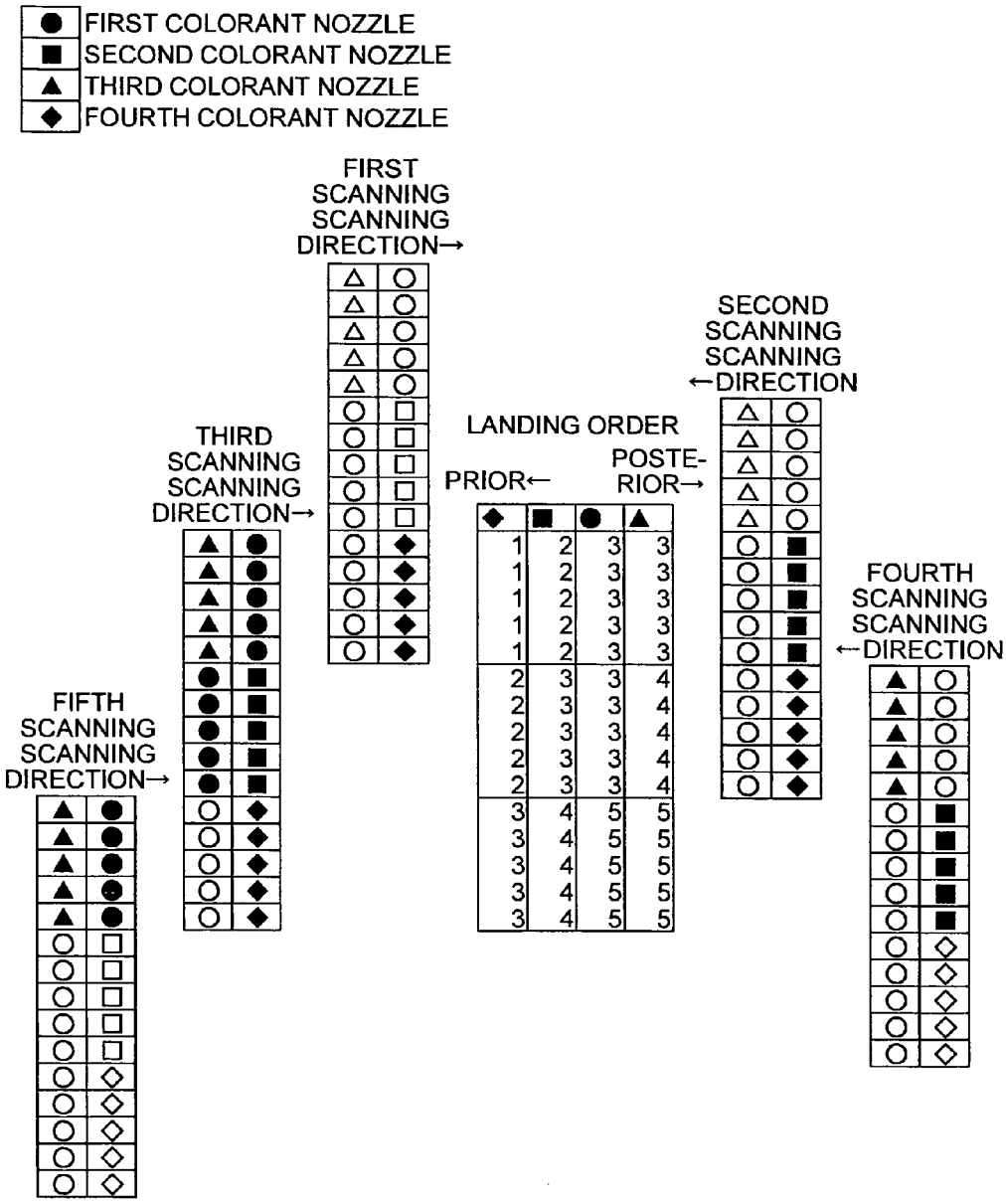
FIG. 14 is a diagram for explaining an overview of control for unifying landing order when a lower end of an image is printed with the head structure illustrated in FIG. 12.

A first modification of the recording head 14 of the first embodiment will be described below with reference to FIGS. 12 to 14. FIG. 12 is a diagram illustrating another example of disposition of nozzles of the recording head 14. FIG. 13 is a diagram for explaining an overview of control for unifying landing order when an upper end of an image is printed with the head structure illustrated in FIG. 12. FIG. 14 is a diagram for explaining an overview of control for unifying landing order when a lower end of an image is printed with the head structure illustrated in FIG. 12.

In FIG. 12, nozzles contained in each nozzle row are divided into three nozzle groups of the first group to the third group in this order from the upstream side to the downstream side in the conveying direction. With this head structure, head movement control and conveyance control are performed as illustrated in FIGS. 13 and 14. Accordingly, the landing order is unified as the order of the fourth colorant, the second colorant, the first colorant, and the third colorant.

Second Modification

In general, a path for supplying colorant to a nozzle (colorant supply path) is formed inside the recording head 14. In the head structure of the first embodiment, nozzles for ejecting different colorants are arrayed in the nozzle row direction. Therefore, in some cases, it is necessary to arrange a region where an unused nozzle is present or where no nozzle is present between nozzles for different types of colorants. This is because supply paths for different colorants interfere with each other in the layout and a nozzle cannot be disposed in the interference area.

Figure 15:
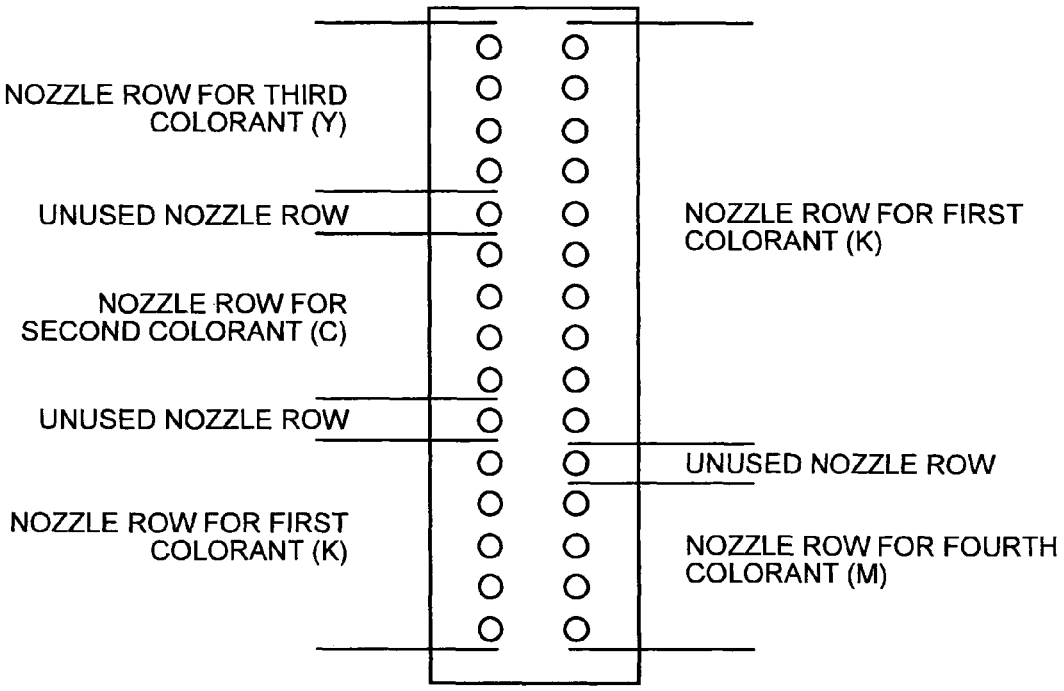
FIG. 15 is a diagram illustrating still another example of disposition of nozzles of the recording head.
Figure 16:
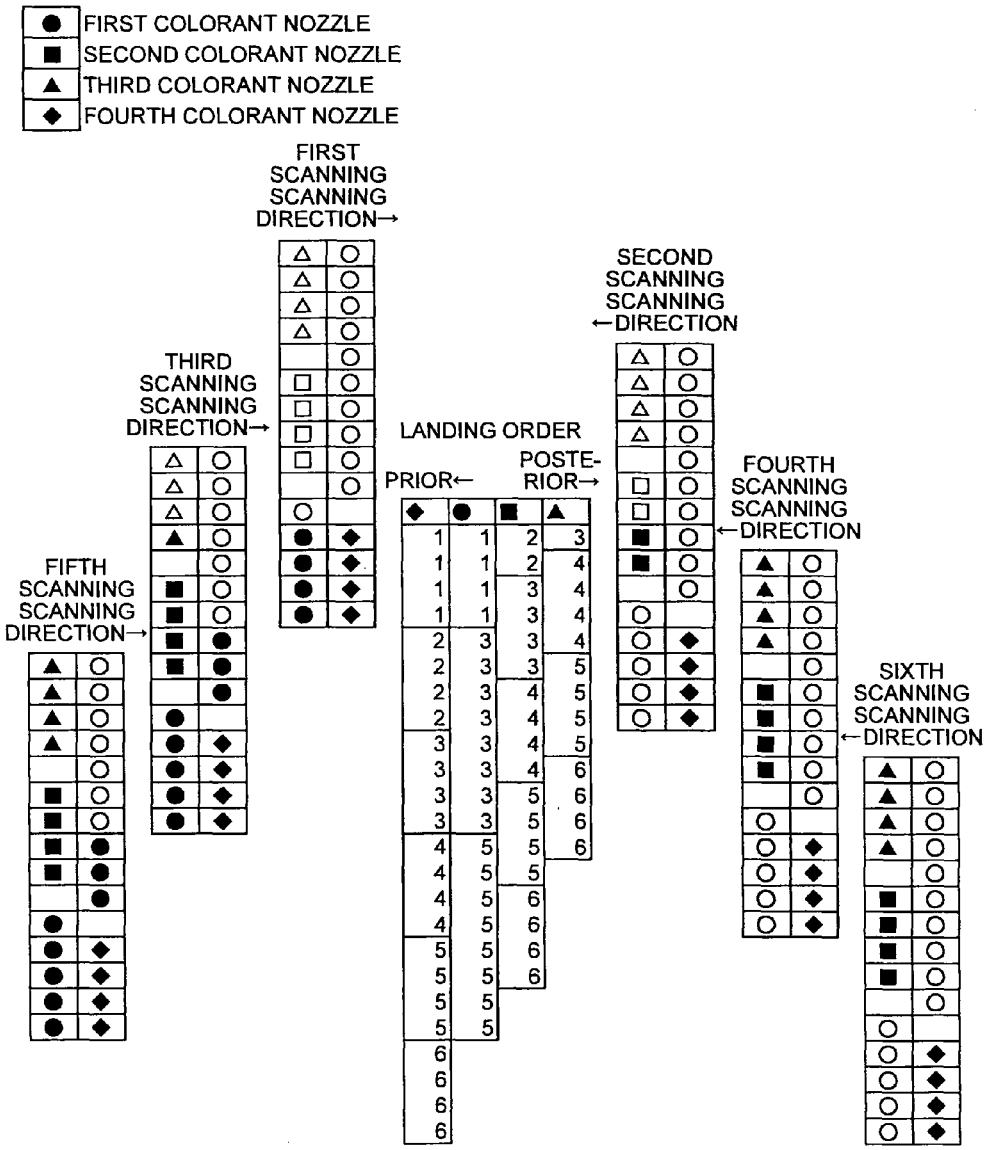
FIG. 16 is a diagram for explaining an overview of control for unifying landing order when an upper end of an image is printed with the head structure illustrated in FIG. 15.
Figure 17:
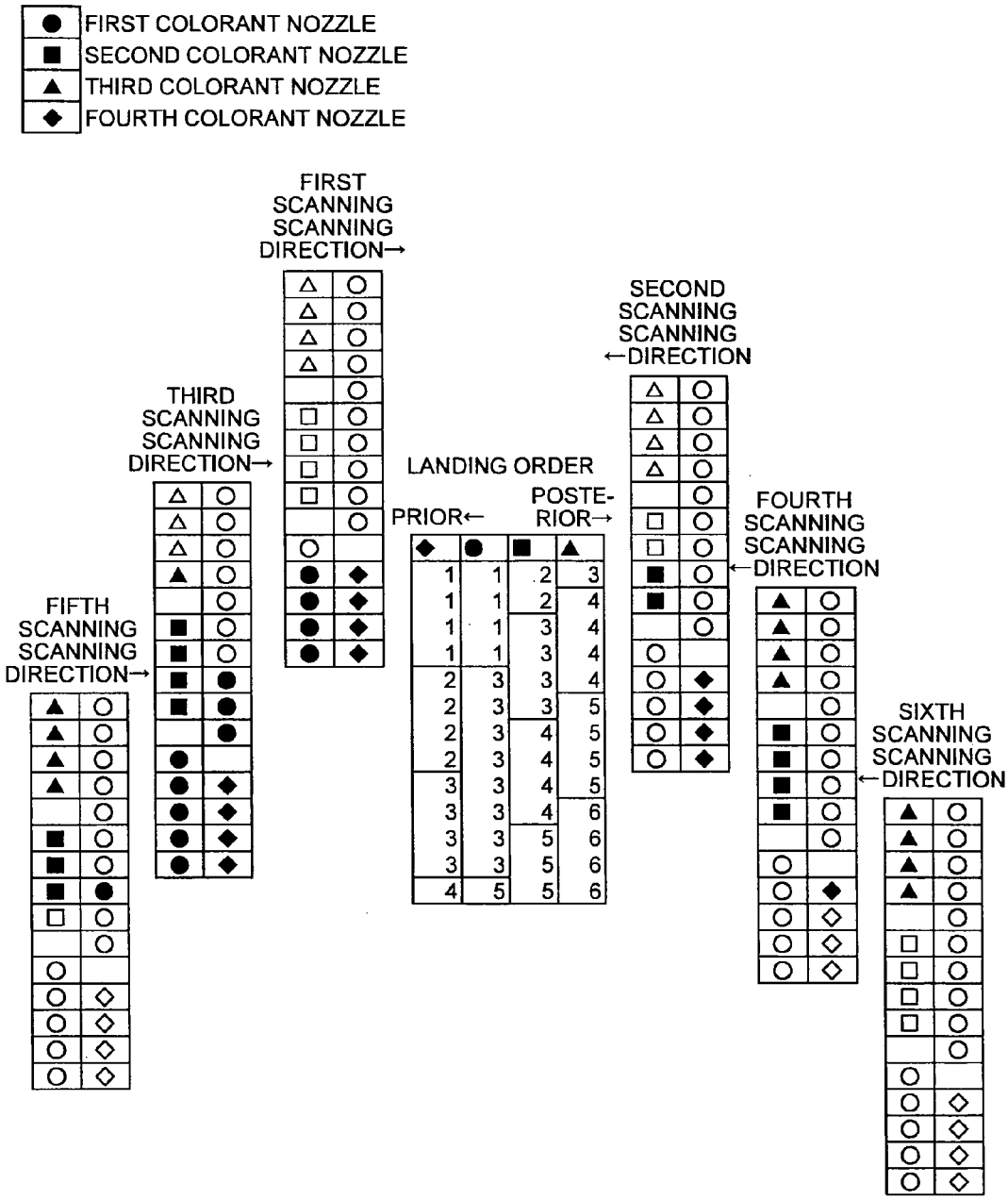
FIG. 17 is a diagram for explaining an overview of control for unifying landing order when a lower end of an image is printed with the head structure illustrated in FIG. 15.
Figure 18:
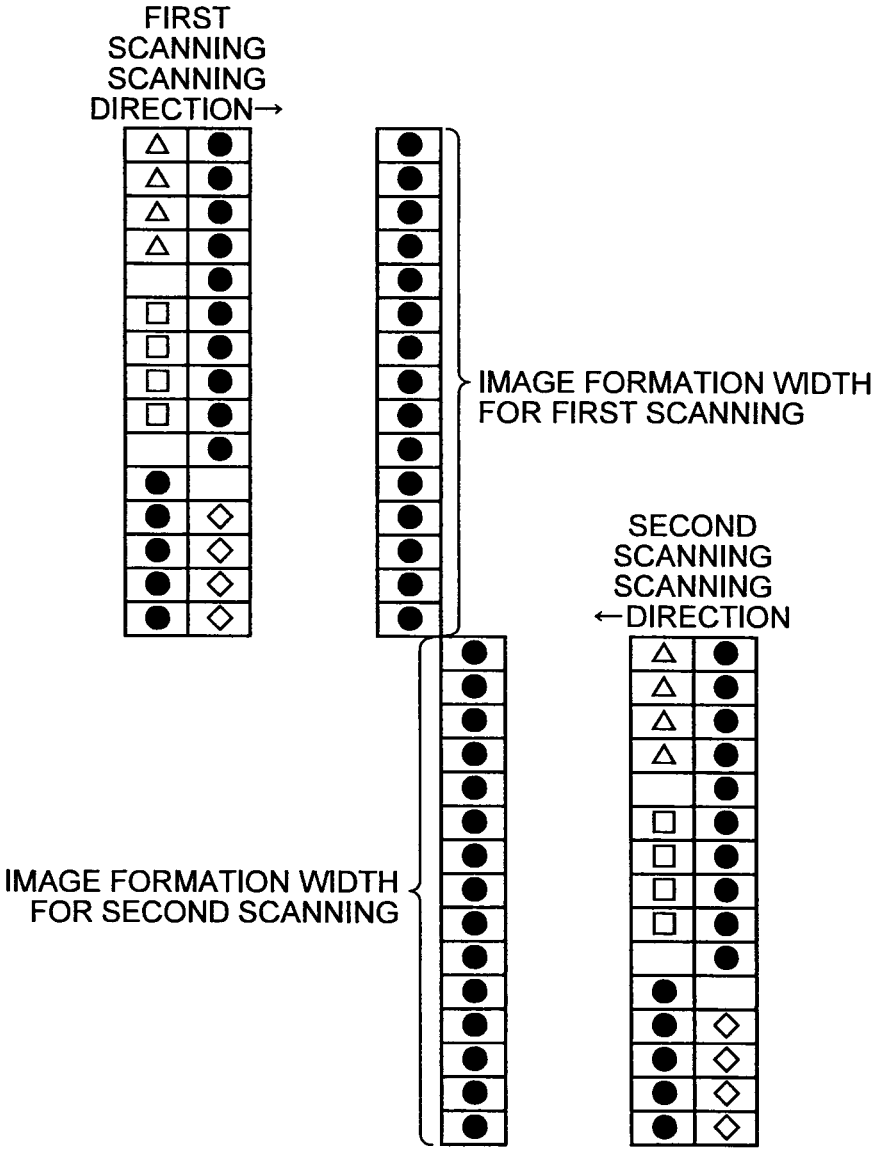
FIG. 18 is a diagram for explaining an overview of control performed when monochrome printing is performed with the head structure illustrated in FIG. 15.

A second modification of the recording head 14 of the first embodiment, in which the above situation is taken into account, will be described below with reference to FIGS. 15 to 18. FIG. 15 is a diagram illustrating still another example of disposition of nozzles of the recording head 14. FIG. 16 is a diagram for explaining an overview of control for unifying landing order of ink when an upper end of an image is printed with the head structure illustrated in FIG. 15. FIG. 17 is a diagram for explaining an overview of control for unifying landing order when a lower end of an image is printed with the head structure illustrated in FIG. 15. FIG. 18 is a diagram for explaining an overview of control performed when monochrome printing is performed with the head structure illustrated in FIG. 15.

As illustrated in FIG. 15, the recording head 14 of the second modification includes, in the first nozzle row, one unused nozzle row between a nozzle row for the third colorant and a nozzle row for the second colorant and other unused nozzle row between a nozzle row for the second colorant and a nozzle row for the first colorant.

Similarly, the recording head 14 of the second medication includes, in the second nozzle row, an unused nozzle row between a nozzle row for the first colorant and a nozzle row for the fourth colorant. In FIG. 15, an example is illustrated in which only one nozzle is contained in each of the unused nozzle row; however, two or more nozzles may be contained.

With the head structure in FIG. 15, head movement control and conveyance control are performed, for example, as illustrated in FIGS. 16 and 17. Therefore, the landing order is unified as the order of the fourth colorant, the first colorant, the second colorant, and the third colorant. Further, when monochrome printing is performed with the head structure of FIG. 15, head movement control and conveyance control are performed, for example, as illustrated in FIG. 18.

When the unused nozzle rows are contained as illustrated in FIG. 15, a doubled-width for the image formation can be maximized at the time of monochrome printing by satisfying the following condition. Namely, (1) the number of unused nozzles in each unused nozzle row is made identical, and (2) the unused nozzles in the first nozzle row and the unused nozzles in the second nozzle row are made not to overlap each other (the unused nozzles in the respective nozzle rows are not adjacent to each other).

As described above, even when there is disposed the unused nozzle row or a region where no nozzle is present at the boundary between the nozzle groups of mutually different colorants, the same method as the above embodiment can be applied.

Third Modification

Figure 19:
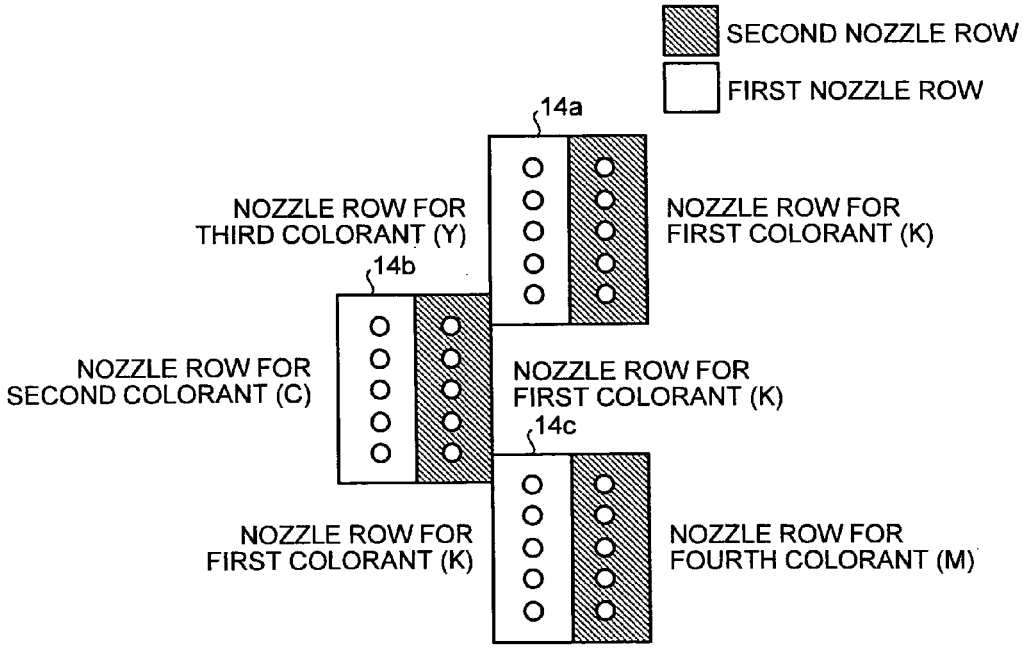
FIG. 19 is a diagram illustrating another configuration example of the recording head.

In the above embodiment and modifications, one recording head 14 is provided and each nozzle row is linearly arranged. In a third modification, an example is explained in which a plurality of recording heads 14 is provided. FIG. 19 is a diagram illustrating another configuration example of the recording head 14. As illustrated in FIG. 19, an inkjet recording apparatus of the third modification includes three recording heads 14*a*, 14*b*, and 14*c*.

The recording heads 14*a*, 14*b*, and 14*c* respectively correspond to the third group, the second group, and the first group of the recording head 14 illustrated in FIG. 8. That is, the third modification is different only in that the recording head 14 is physically divided into three heads, and the head movement control and the conveyance control can be performed by applying the same method as that of the recording head 14 illustrated in FIG. 8.

Fourth Modification

Figure 20:
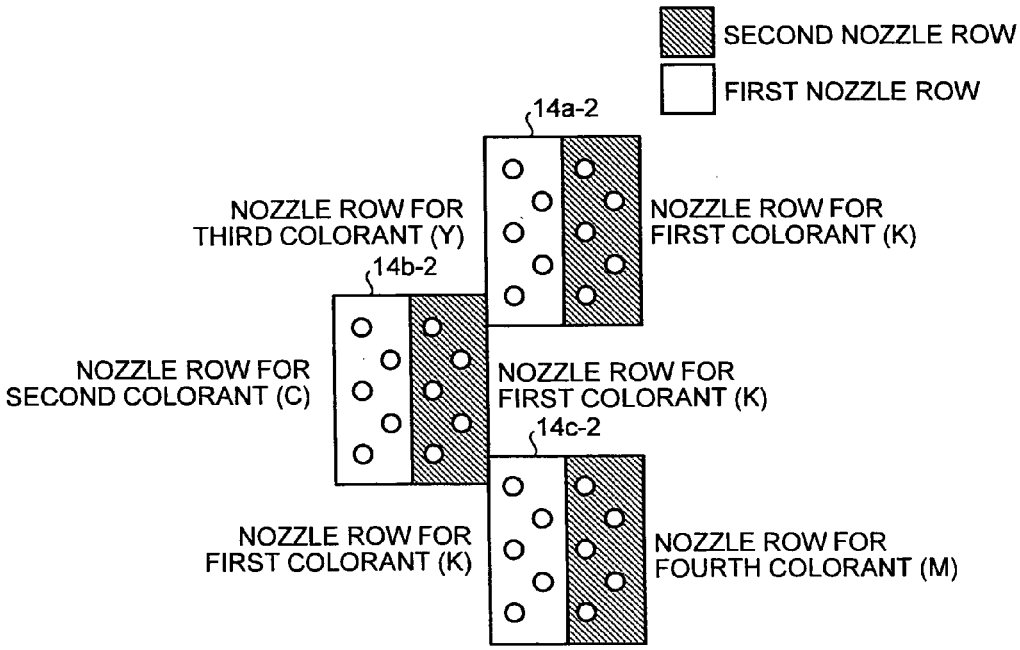
FIG. 20 is a diagram illustrating another configuration example of the recording head.

In a fourth modification, an example will be described in which a plurality of recording heads 14 is provided as similarly to the third modification, where nozzle rows are arranged in a zigzag manner. FIG. 20 is a diagram illustrating another configuration example of the recording head 14. As illustrated in FIG. 20, an inkjet recording apparatus of the fourth modification includes three recording heads 14*a*-2, 14*b*-2, and 14*c*-2.

As in FIG. 20, the fourth modification is different from the third modification in that nozzles in each nozzle row are arranged in a zigzag manner. The head movement control and the conveyance control can be performed by applying the same method as that of the third modification.

As described above, according to the inkjet recording apparatus of the first embodiment, black nozzles and color nozzles are disposed at least in two nozzle rows so that (1) the black nozzles and the color nozzles are arranged in, the nozzle row direction, (2) a part of the black nozzles and a part of the color nozzles are interchanged with each other between the nozzle rows, (3) the number of the black nozzles is greater than the number of the color nozzles. Accordingly, the landing order of colorants in the bidirectional printing can be unified. With this arrangement, it is possible to form an image with unified landing order by at least three head scanning. In this case, the color nozzles are driven in the forward direction and the backward direction of scanning while the black nozzles are driven only in one direction of the scanning.

As described above, according to the inkjet recording apparatus of the first embodiment, band unevenness that occurs during color bidirectional printing can be relieved by simple nozzle arrangement. Besides, the speed of black monochrome printing can be made several times faster than the speed of color printing.

In the above example, a droplet ejected from the recording head 14 is an ink, droplet for each color used for printing a color image; however, the present invention is not limited to this example. For example, the droplet may be a droplet of fixation adjuvant or a droplet of glaze control agent. Even for these droplets, according to the method of the present embodiment, the landing order at the time of bidirectional ejection of a droplet can be unified and the speed of ejection of a specific type of a droplet among a plurality of types of droplets can be increased with a simple head structure.

Second Embodiment

In the first embodiment, an example is explained in which the color nozzle and the black nozzle are interchanged with each other at the end portion of the nozzle row. For example, in the head structure of FIG. 8, the black nozzles arranged in the second nozzle row and the color nozzles arranged in the first nozzle row are interchanged with each other in the one of the nozzle groups (first group) at the end portion on the upstream side in the conveying direction. Further, in the head structure illustrated in FIG. 12, the black nozzles arranged in the first nozzle row and the color nozzles arranged in the second nozzle row are interchanged with each other in the one of the nozzle groups (second group) at the end portion on the upstream side in the conveying direction.

In the second embodiment, an explanation will be given of unification of the landing order at the time of bidirectional printing and control for high-speed monochrome printing with the head structure in which color nozzles are arranged in a zigzag manner. The configurations of a whole mechanical unit and a control unit of an inkjet recording apparatus of the second embodiment are the same as those illustrated in FIGS. 1 to 7, and therefore, explanation thereof is not repeated.

Figure 21:
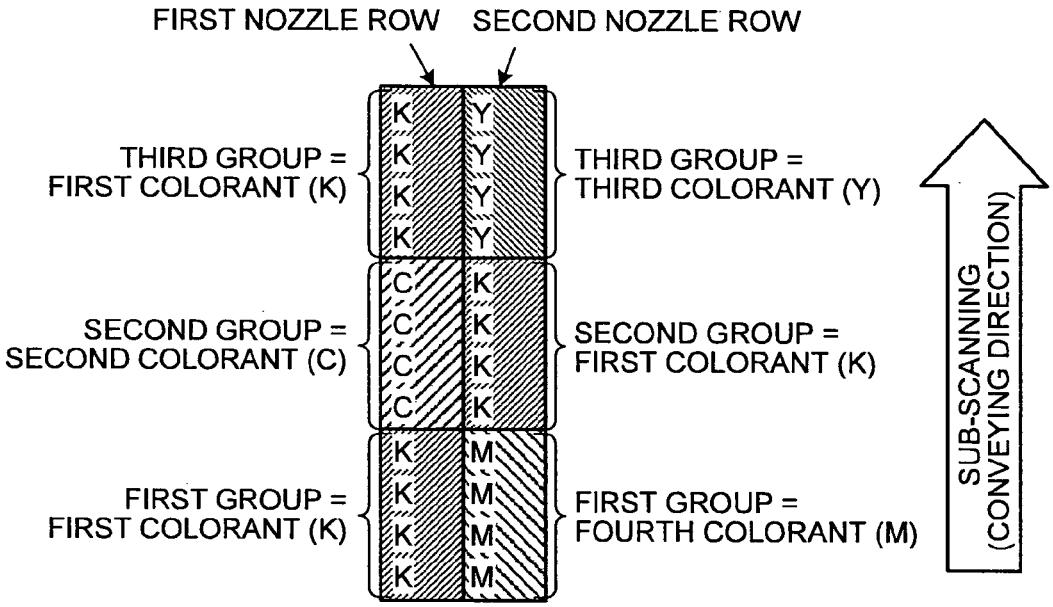
FIG. 21 is a diagram illustrating an example of disposition of nozzles of a recording head according to a second embodiment.

FIG. 21 is a diagram illustrating an example of disposition of nozzles of a recording head 214 according to the second embodiment. In FIG. 21, an example is illustrated in which the first group, the second group, and the third group in the first nozzle row contain nozzles for the first colorant, nozzles for the second colorant, and nozzles for the first colorant, respectively. Further, in FIG. 21, an example is illustrated in which the first group, the second group, and the third group in the second nozzle row contain nozzles for the fourth colorant, nozzles for the first colorant, and nozzles for the third colorant, respectively.

The head configuration of FIG. 21 is one example. For example, a head structure described below may be applied. Specifically, when an image is formed by using p types of colorants (p is an integer equal to or greater than three), the first nozzle row is divided into $(p-1)$ groups such that the m-th group (m is an odd number that satisfies $1 \leq m \leq (p-1)$) handles the first colorant and the n-th group handles the n-th colorant (n is an even number that satisfies $2 \leq n \leq (p-1)$). Further, the second nozzle row is divided into $(p-1)$ groups such that the h-th group (h is an odd number that satisfies $1 \leq h \leq (p-1)$ handles the h-th colorant and the i-th group (i is an even number that satisfies $2 \leq i \leq (p-1)$) handles the first colorant. The colorants for the n-th group and the h-th group are mutually different types of colorants among the p-types of colorants.

Figure 22:
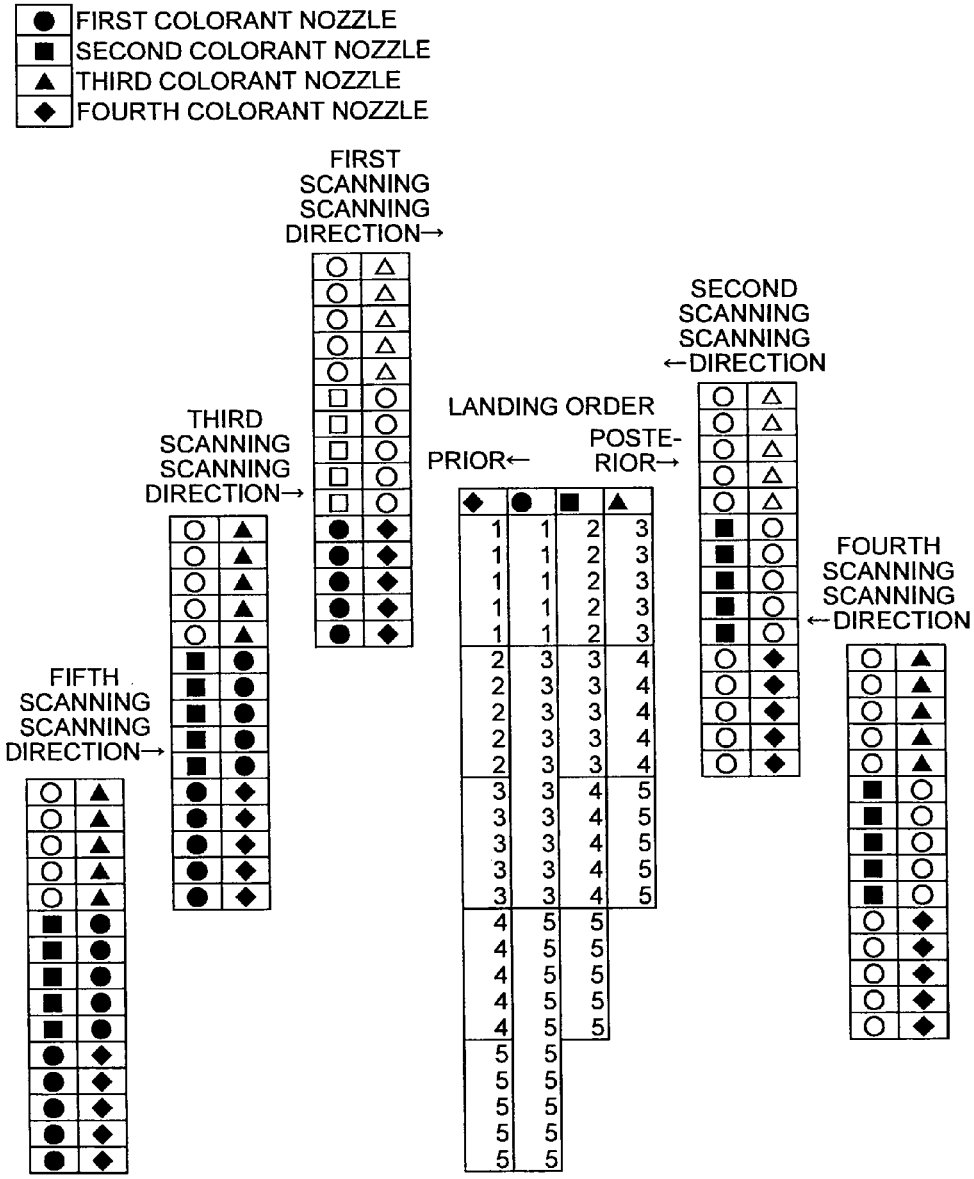
FIG. 22 is a diagram for explaining an overview of control for unifying landing order when an upper end of an image is printed.
Figure 23:
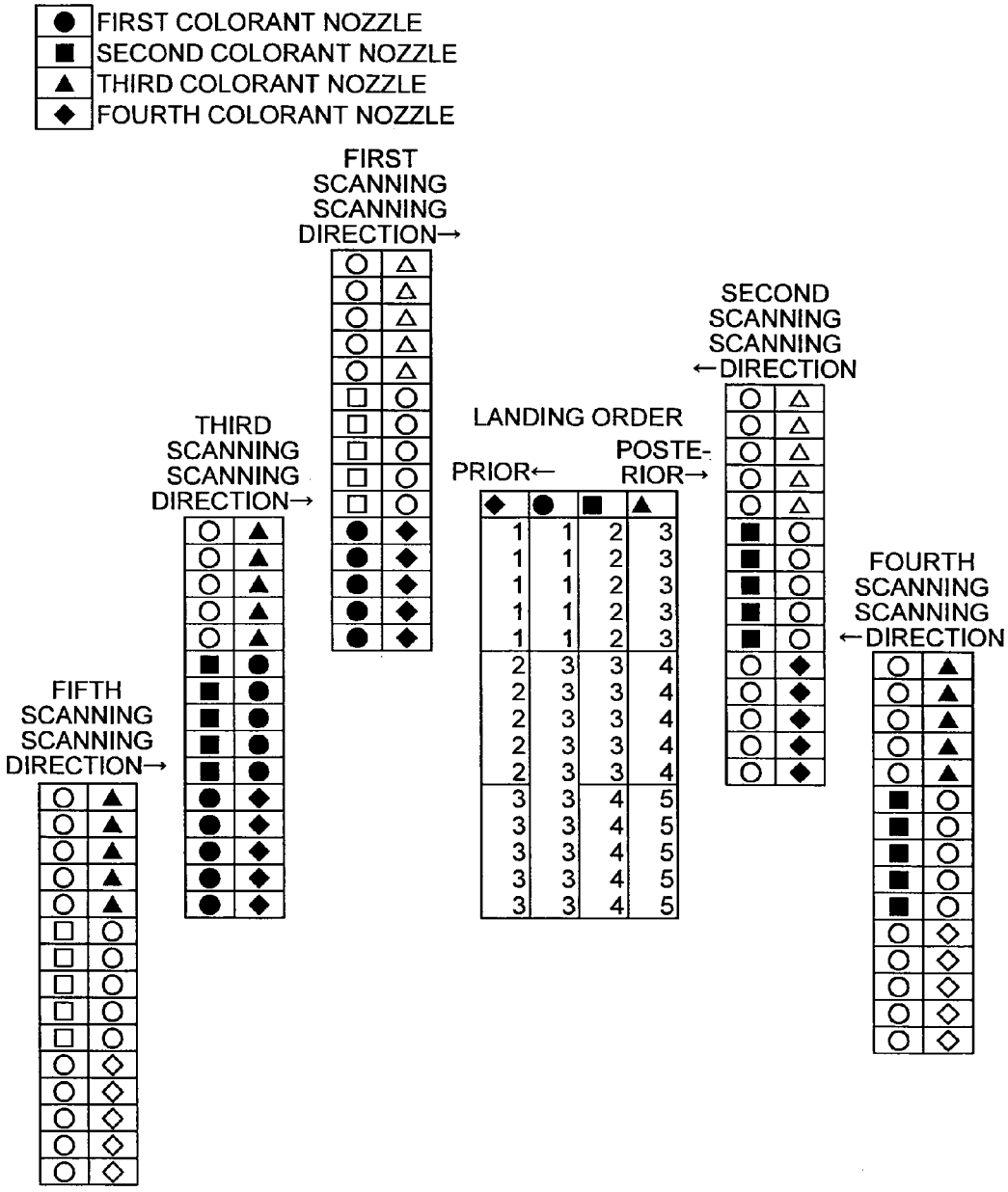
FIG. 23 is a diagram for explaining an overview of control for unifying landing order when a lower end of an image is printed.
Figure 24:
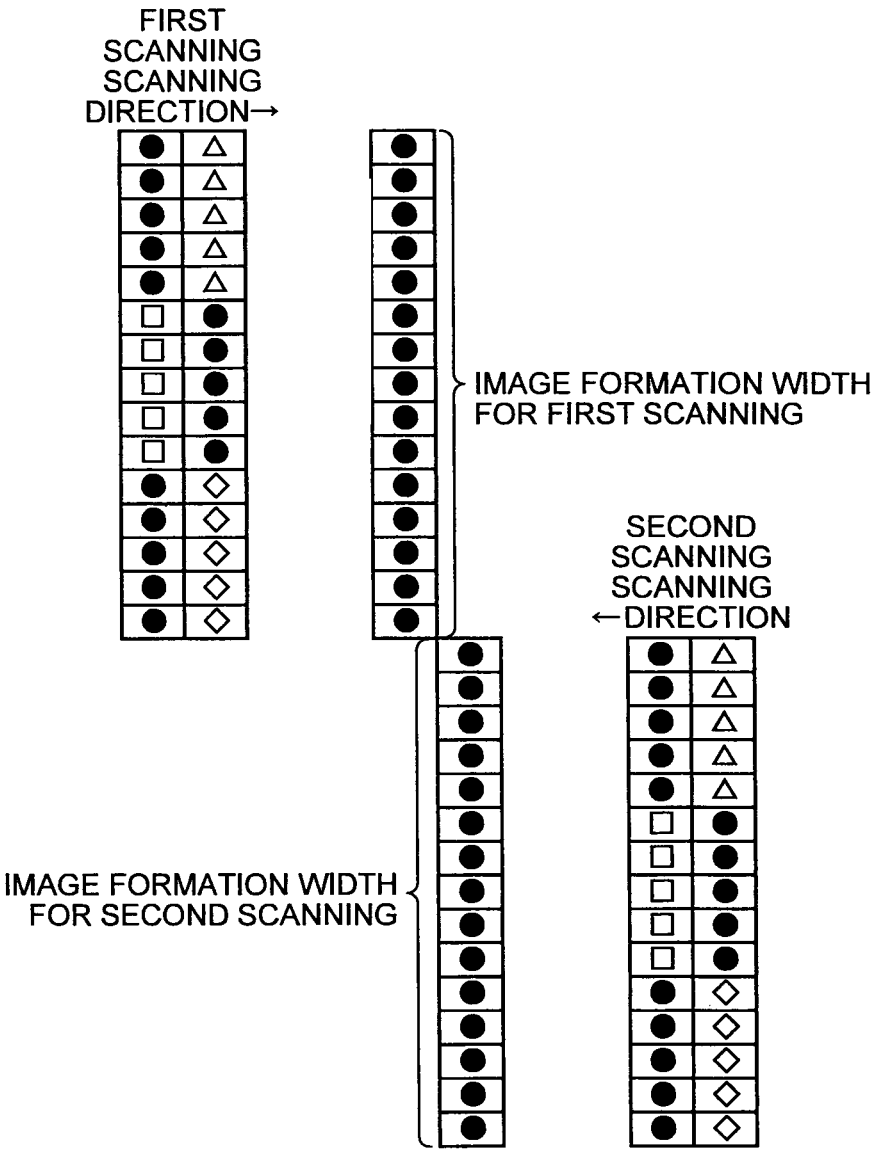
FIG. 24 is a diagram for explaining an overview of control performed when monochrome printing is performed with the head structure illustrated in FIG. 21.

An explanation will be given of, with reference to FIGS. 22 to 24, a control method for unifying the landing order at the time of bidirectional printing by the recording head 214 configured as illustrated in FIG. 21. FIG. 22 is a diagram for explaining an overview of control for unifying landing order of ink when an upper end of an image is printed. FIG. 23 is a diagram for explaining an overview of control for unifying landing order of ink when a lower end of an image is printed. FIG. 24 is a diagram for explaining an overview of control performed when monochrome printing is performed with the head structure illustrated in FIG. 21.

With the head structure of FIG. 21, head movement control and conveyance control as illustrated in FIGS. 22 and 23 are performed, so that the landing order is unified as the order of the fourth colorant, the first colorant, the second colorant, and the third colorant. When monochrome printing is performed with the head structure as illustrated in FIG. 21, head movement control and conveyance control are performed, for example, as illustrated in FIG. 24.

First Modification

Figure 25:
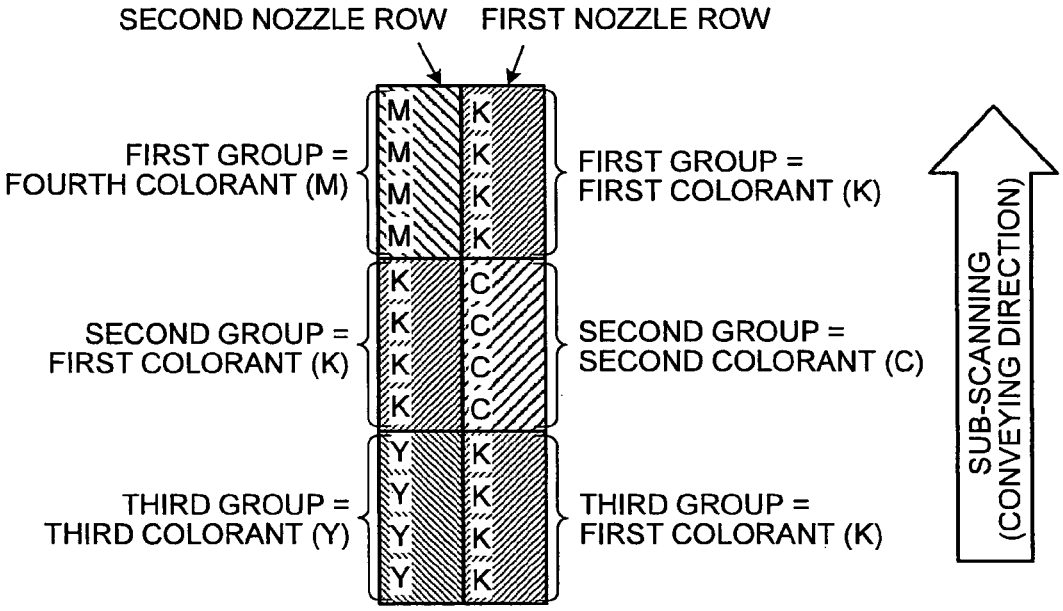
FIG. 25 is a diagram illustrating another example of disposition of nozzles of the recording head.
Figure 26:
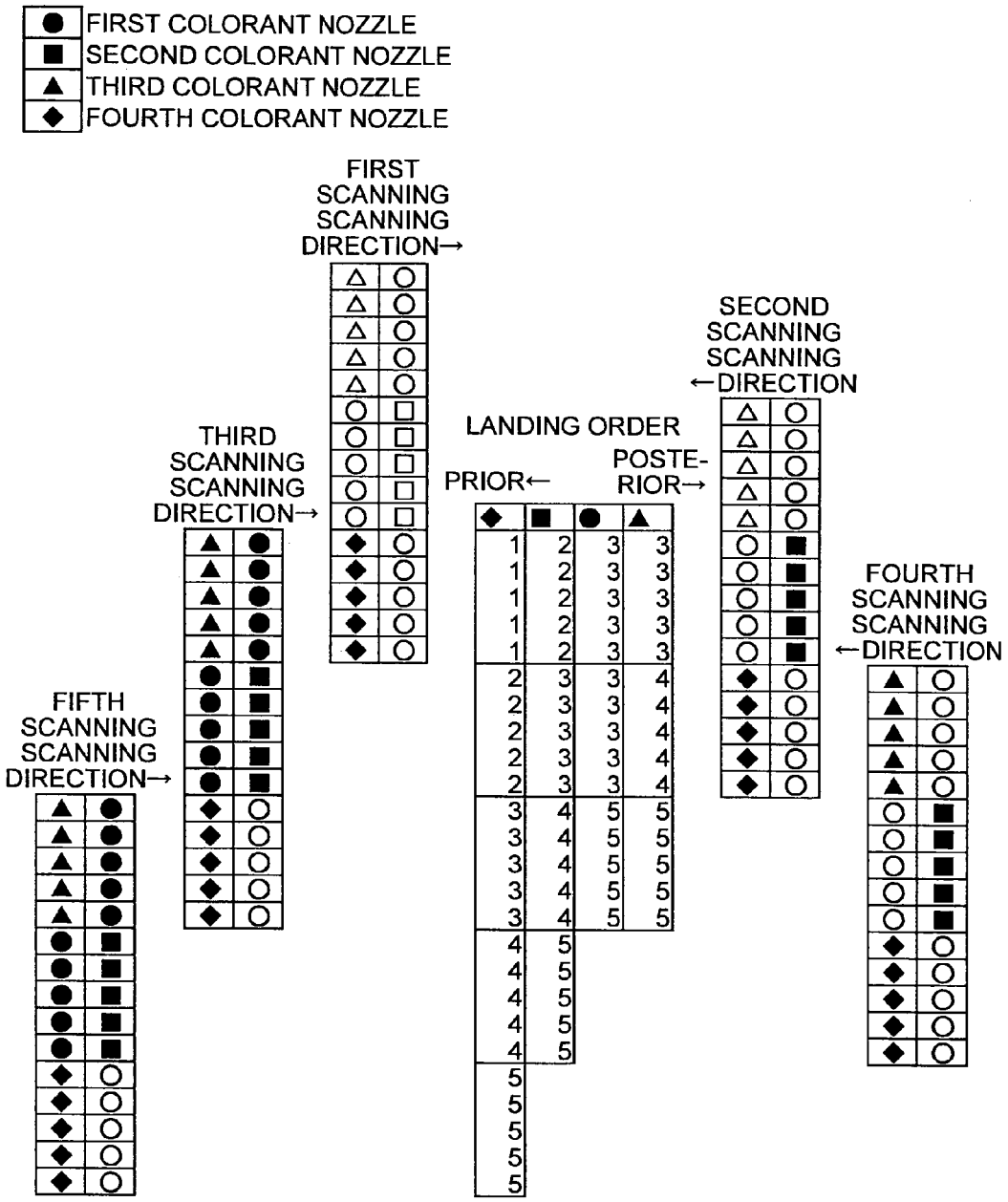
FIG. 26 is a diagram for explaining an overview of control for unifying landing order when an upper end of an image is printed with the head structure illustrated in FIG. 25.
Figure 27:
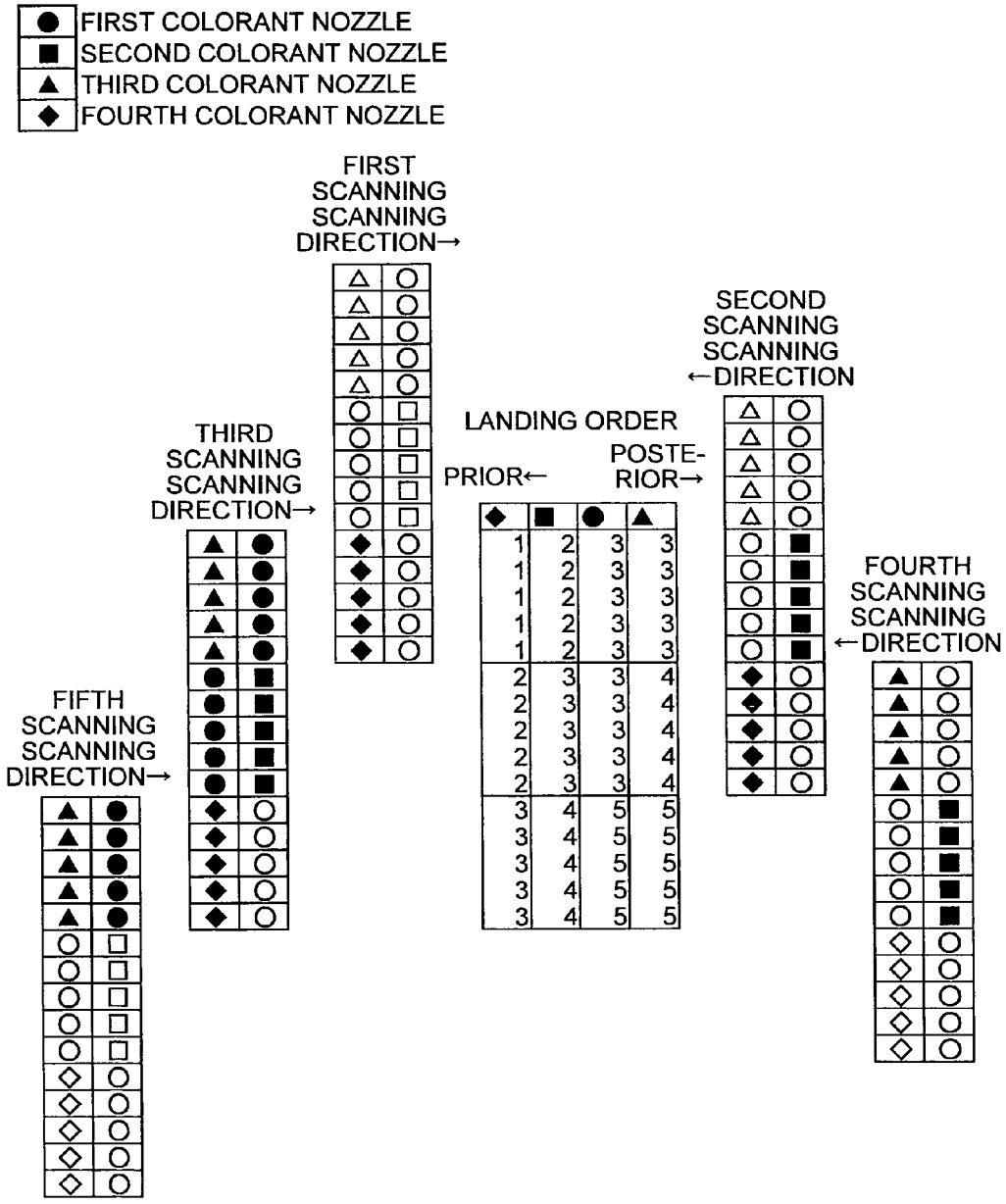
FIG. 27 is a diagram for explaining an overview of control for unifying landing order when a lower end of an image is printed with the head structure illustrated in FIG. 25.

A first modification of the recording head 214 of the second embodiment will be described below with reference to FIGS. 25 to 27. FIG. 25 is a diagram illustrating another example of disposition of nozzles of the recording head 214. FIG. 26 is a diagram for explaining an overview of control for unifying landing order of ink when an upper end of an image is printed with the head structure illustrated in FIG. 25. FIG. 27 is a diagram for explaining an overview of control for unifying landing order when a lower end of an image is printed with the head structure illustrated in FIG. 25.

With the head structure of FIG. 25, head movement control and conveyance control are performed as illustrated in FIGS. 26 and 27. Accordingly, the landing order is unified as the order of the fourth colorant, the second colorant, the first colorant, and the third colorant.

Second Modification

Figure 28:
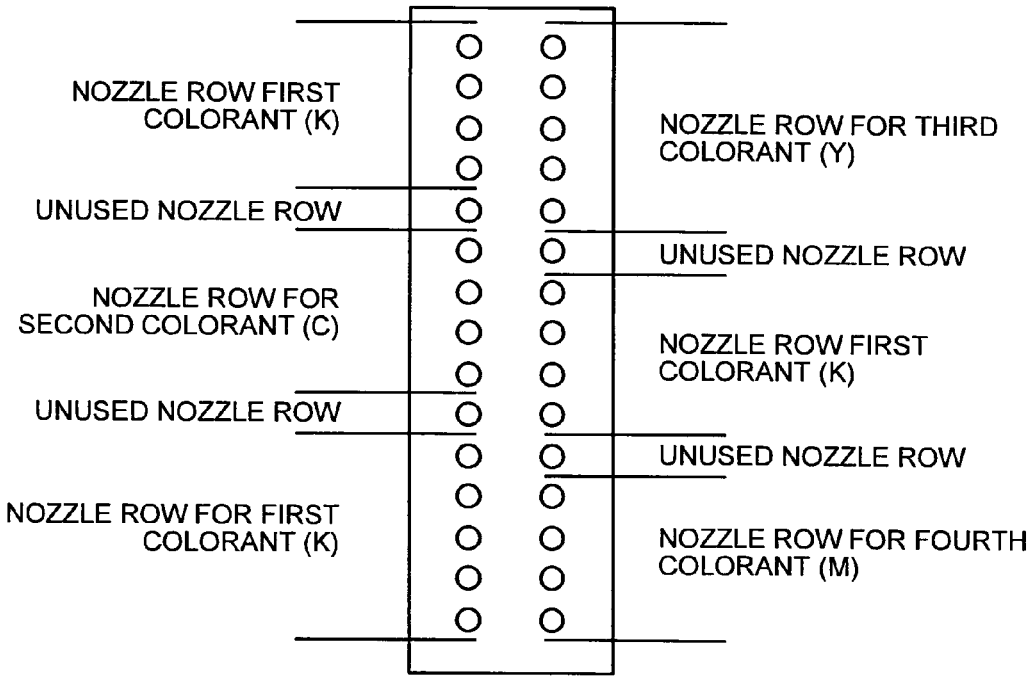
FIG. 28 is a diagram illustrating still another example of disposition of nozzles of the recording head.
Figure 29:
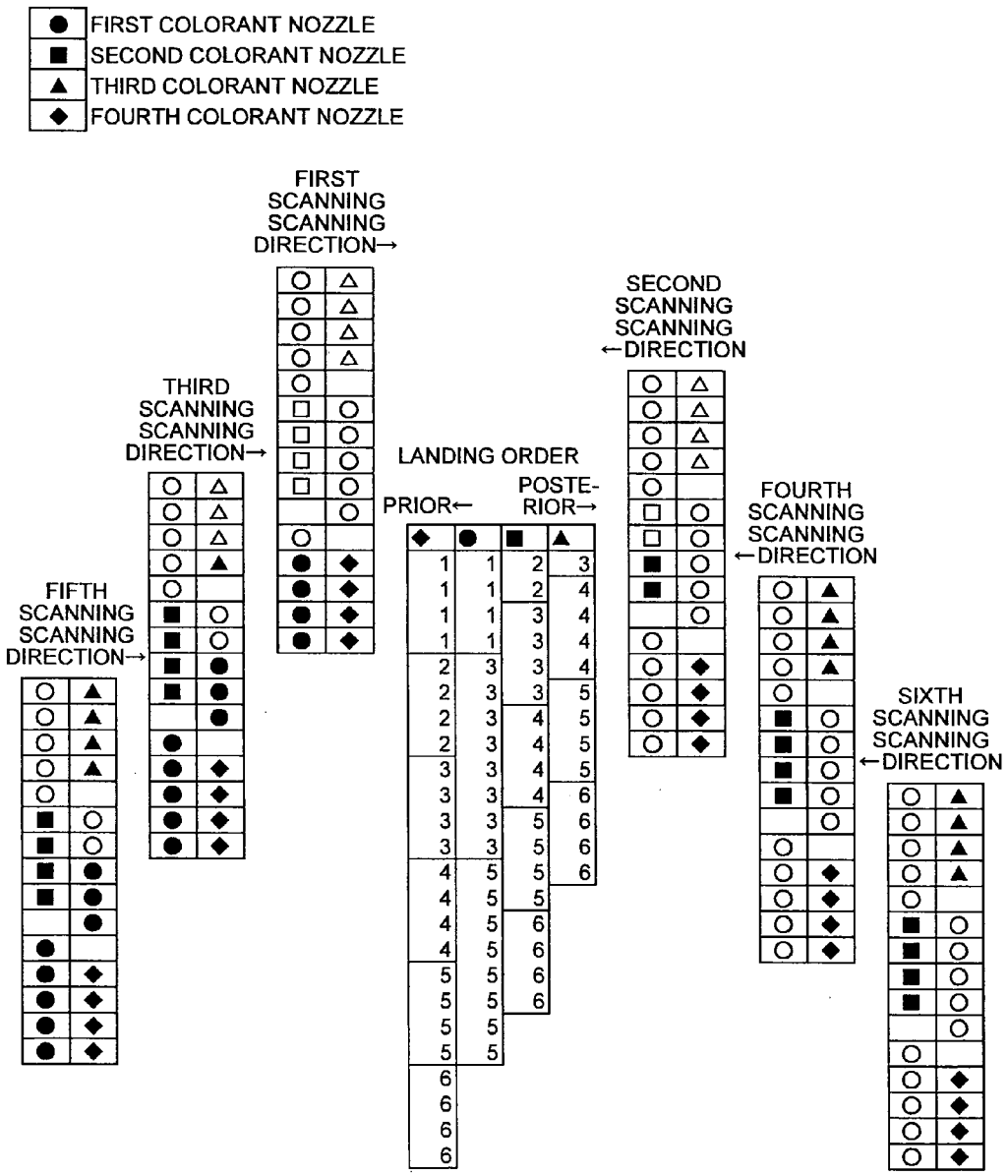
FIG. 29 is a diagram for explaining an overview of control for unifying landing order when an upper end of an image is printed with the head structure illustrated in FIG. 28.
Figure 30:
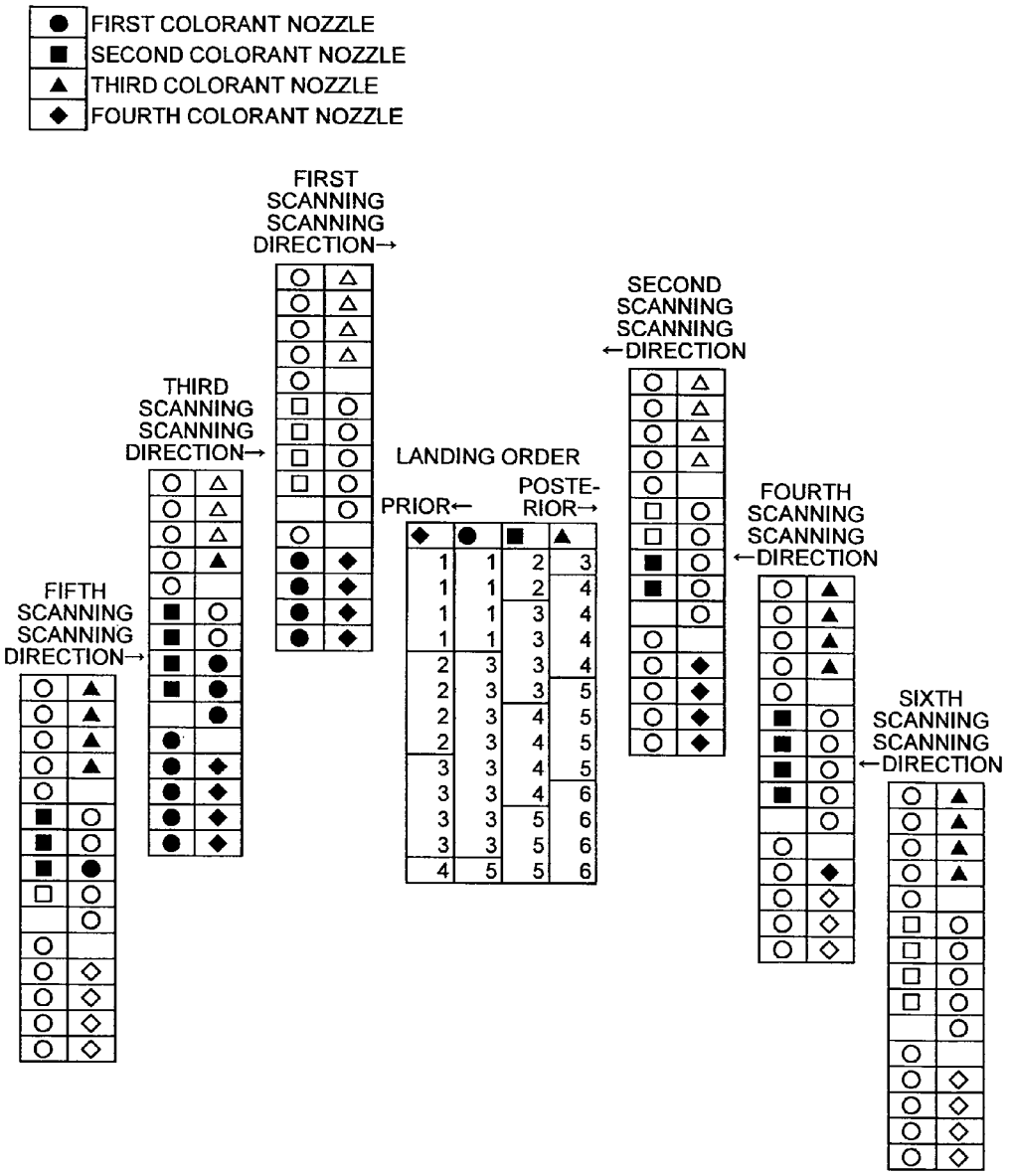
FIG. 30 is a diagram for explaining an overview of control for unifying landing order when a lower end of an image is printed with the head structure illustrated in FIG. 28.
Figure 31:
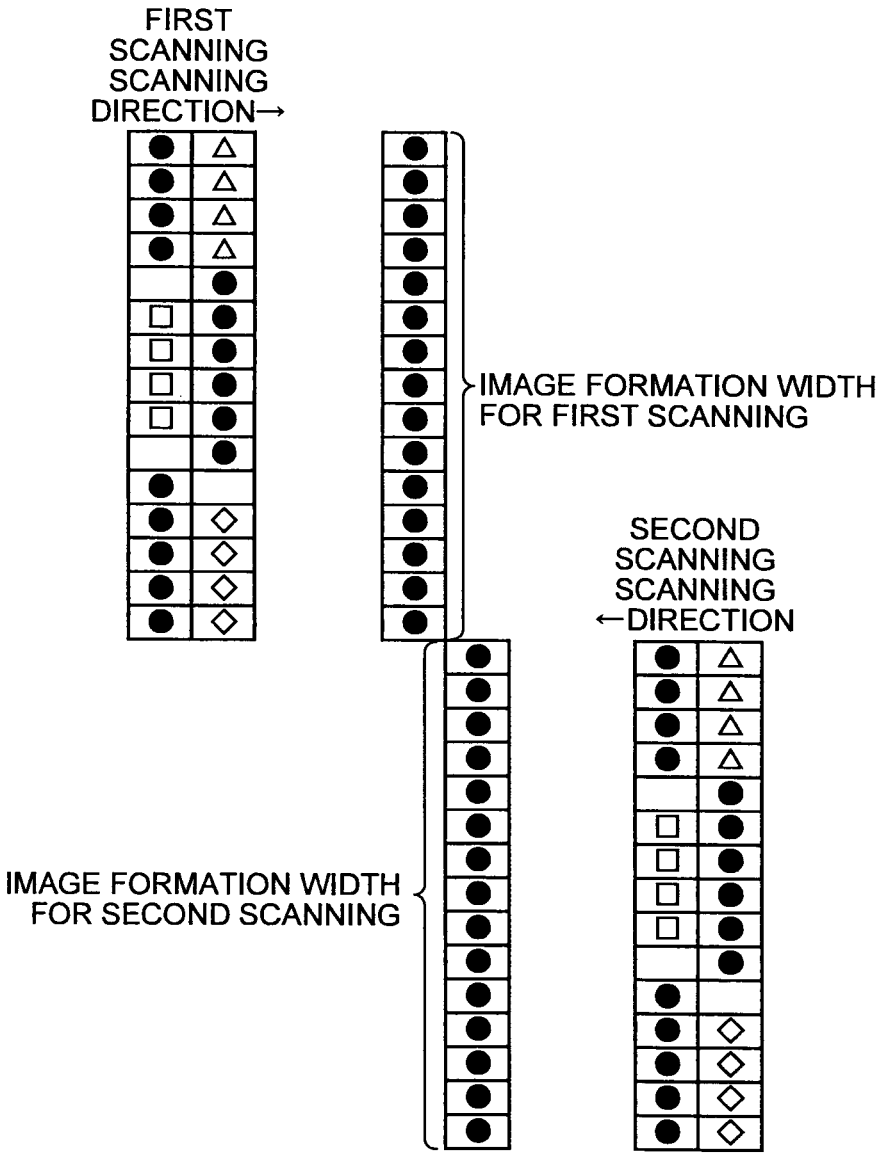
FIG. 31 is a diagram for explaining an overview of control performed when monochrome printing is performed with the head structure illustrated in FIG. 28.

A second modification of the recording head 214 of the second embodiment will be described below with reference to FIGS. 28 to 31. FIG. 28 is a diagram illustrating still another example of disposition of nozzles of the recording head 214. FIG. 29 is a diagram for explaining an overview of control for unifying landing order of ink when an upper end of an image is printed with the head structure of FIG. 28. FIG. 30 is a diagram for explaining an overview of control for unifying landing order of ink when a lower end of an image is printed with the head structure of FIG. 28. FIG. 31 is a diagram for explaining an overview of control performed when monochrome printing is performed with the head structure of FIG. 28.

As illustrated in FIG. 28, the recording head 214 of the second modification includes one unused nozzle row between one nozzle row for the first colorant and a nozzle row for the second colorant, and another unused nozzle row between the nozzle row for the second colorant and another nozzle row for the first colorant, in the first nozzle row. Similarly, the recording head 214 of the second modification includes, in the second nozzle row, one unused nozzle row between a nozzle row for the third colorant and a nozzle row for the first colorant and another unused nozzle row between a nozzle row for the first colorant and a nozzle row for the fourth colorant.

With the head structure of FIG. 28, head movement control and conveyance control are performed, for example, as illustrated in FIGS. 29 and 30. Accordingly, the landing order is unified as the order of the fourth colorant, the first colorant, the second colorant, and the third colorant. Further, when monochrome printing is performed with the head structure of FIG. 28, head movement control and conveyance control are performed, for example, as illustrated in FIG. 31.

As described above, according to the recording head 214 of the second embodiment, with the same control as that of the first embodiment, it is possible to relieve band unevenness at the time of bidirectional printing and increase the speed of black monochrome printing than the speed of color printing with a simple nozzle arrangement.

According to one aspect of the present invention, with a simple nozzle arrangement, landing order of ink for the bidirectional printing can be unified and speed for the monochrome printing can be increased.

Best modes for carrying out the present invention are described above. However, the present invention is not limited to the embodiments described above as the best modes. The present invention can be modified without departing from the scope of the present invention.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The invention claimed is:

1. An image forming apparatus comprising:

a recording head having a first nozzle row and a second nozzle row that are adjacent to each other in a direction perpendicular to a conveying direction of a recording medium, a plurality of nozzles being arrayed in the conveying direction in each of the first nozzle row and the second nozzle row, each of the nozzles ejecting one of p types of droplets including a predetermined specific type of droplets, where p is an integer equal to or greater than three;

a moving unit that relatively reciprocates the recording medium and the recording head in a direction perpendicular to the conveying direction; and a control unit that controls ejection of the p types of droplets from the nozzles, wherein the plurality of nozzles in each of the first nozzle row and the second nozzle row, respectively, are divided into (p−1) nozzle groups in the conveying direction, first nozzles of nozzles in a k-th nozzle group ($1 \le k \le p-1$) in the conveying direction and in the first nozzle row ejects the specific type of droplets, and second nozzles of the nozzles in the k-th nozzle group in the conveying direction and in other one of the first nozzle row and the second nozzle row ejects one of the p types of droplets other than the specific type of droplets, nozzles of each of the (p−1) nozzle groups that do not eject the specific type of droplets eject a different one of the p types of droplets other than the specific type of droplets, nozzles of a first of the (p−1) nozzle groups ejecting the specific type of droplets at first in the conveying direction and nozzles of a second of the (p−1)nozzle groups ejecting the specific type of droplets at second in the conveying direction belong to different nozzle rows, the control unit controls to eject, in a first of directions of the reciprocal movement, the p types of droplets other than the specific type of droplets from the nozzles of each of the (p−1) nozzle groups that do not eject the specific type of droplets, the specific type of droplets from the nozzles of the first of the (p−1) nozzle groups ejecting the specific type of droplets at first in the conveying direction and from the nozzles of the second of the (p−1) nozzle groups ejecting the specific type of droplets at second in the conveying direction, the control unit controls to eject, in a second of the directions of the reciprocal movement, the p types of droplets other than the specific type of droplets from the nozzles of each of the (p−1) nozzle groups that do not eject the specific type of droplets, and third nozzles and forth nozzles of the plurality of nozzles eject the specific type of droplets, the third nozzles being in the first nozzle row and in a first nozzle group of the (p−1) nozzle groups in the conveying direction, the forth nozzles being in the second nozzle row and in a second to (p−1)-th nozzle groups of the (p−1) nozzle groups in the conveying direction.

2. The image forming apparatus according to claim 1, wherein the first nozzle row and the second nozzle row are arranged from an upstream side to a downstream side in a forward direction of the reciprocal movement, the nozzles of the first of the (p−1) nozzle groups ejecting the specific type of droplets at first in the conveying direction from the upstream side thereof belong to the first nozzle row, the nozzles of the second of the (p−1) nozzle groups ejecting the specific type of droplets at second in the conveying direction from the upstream side thereof belong to the second nozzle row, the control unit controls to eject, in the forward direction of the reciprocal movement, the p types of droplets other than the specific type of droplets from the nozzles of each of the (p−1) nozzle groups that do not eject the specific type of droplets, and the specific type of droplets from the nozzles of the first of the (p−1) nozzle groups ejecting the specific type of droplets at first in the conveying direction and from the nozzles of the second of the (p−1) nozzle groups ejecting the specific type of droplets at second in the conveying direction, and the control unit controls to eject, in a backward direction of the reciprocal movement, the p types of droplets other than the specific type of droplets from the nozzles of each of the (p−1) nozzle groups that do not eject the specific type of droplets.

3. The image forming apparatus according to claim 1, wherein the first nozzle row and the second nozzle row are arranged from an upstream side to a downstream side in a forward direction of the reciprocal movement, the nozzles of the first of the (p−1) nozzle groups ejecting the specific type of droplets at first in the conveying direction from the downstream side belong to the second nozzle row, the nozzles of the second of the (p−1) nozzle groups ejecting the specific type of droplets at second in the conveying direction from the downstream side belong to the first nozzle row, the control unit controls to eject, in the forward direction of the reciprocal movement, the p types of droplets other than the specific type of droplets from the nozzles of each of the (p−1) nozzle groups that do not eject the specific type of droplets, and the specific type of droplets from the nozzles of the first of the (p−1) nozzle groups ejecting the specific type of droplets at first in the conveying direction and from the nozzles of the second of the (p−1) nozzle groups ejecting the specific type of droplets at second in the conveying direction, and the control unit controls to eject, in a backward direction of the reciprocal movement, the p types of droplets other than the specific type of droplets from the nozzles of each of the (p−1) nozzle groups that do not eject the specific type of droplets.

4. The image forming apparatus according to claim 1, wherein nozzles of odd-numbered nozzle groups of the (p−1) nozzle groups in the first nozzle row in the conveying direction and nozzles of even-numbered nozzle groups of the (p−1) nozzle groups in the second nozzle row in the conveying direction eject the specific type of droplets.

5. The image forming apparatus according to claim 1, wherein each of the (p−1) nozzle groups contains a same number of nozzles.

6. The image forming apparatus according to claim 1, wherein, when nozzles in adjacent nozzle groups in the same nozzle row eject different types of droplets, the nozzles in the adjacent nozzle groups contain at least one nozzle that does not eject the droplets at a boundary of the adjacent nozzle groups.

7. The image forming apparatus according to claim 6, wherein each of the adjacent nozzle groups containing the nozzle that does not eject the droplets at the boundary thereof contains a same number of the nozzle that does not eject the droplets.

8. The image forming apparatus according to claim 6, wherein a nozzle that does not eject the droplets in the adjacent nozzle groups in the first nozzle row and a nozzle that does not eject the droplets in the adjacent nozzle groups in the second nozzle row are disposed so as not to be adjacent to each other in the direction perpendicular to the conveying direction.

9. A control method implemented by an image forming apparatus that includes:

a recording head having a first nozzle row and a second nozzle row that are adjacent to each other in a direction perpendicular to a conveying direction of a recording medium, a plurality of nozzles being arrayed in the conveying direction in each of the first nozzle row and the second nozzle row, each of the nozzles ejecting one of p types of droplets including a predetermined specific type of droplets, where p is an integer equal to or greater than three, wherein the plurality of nozzles in each of the first nozzle row and the second nozzle row, respectively, are divided into (p−1) nozzle groups in the conveying direction, first nozzles of nozzles in a k-th nozzle group ($1 \leq k \leq p-1$) in the conveying direction and in the first nozzle row ejects the specific type of droplets, and second nozzles of the nozzles in the k-th nozzle group in the conveying direction and in the second nozzle row ejects one of the p types of droplets other than the specific type of droplets, nozzles of each of the (p−1) nozzle groups that do not eject the specific type of droplets eject a different one of the p types of droplets other than the specific type of droplets, nozzles of a first of the (p−1) nozzle groups ejecting the specific type of droplets at first in the conveying direction and nozzles of a second of the (p−1) nozzle groups ejecting the specific type of droplets at second in the conveying direction belong to different nozzle rows, the control method comprising:

relatively reciprocating the recording medium and the recording head in a direction perpendicular to the conveying direction;

controlling to eject, in a first of directions of the reciprocal movement, the p types of droplets other than the specific type of droplets from the nozzles of each of the (p−1) nozzle groups that do not eject the specific type of droplets, the specific type of droplets from the nozzles of the first of the (p−1) nozzle groups ejecting the specific type of droplets at first in the conveying direction and from the nozzles of the second of the (p−1) nozzle groups ejecting the specific type of droplets at second in the conveying direction; and controlling to eject, in a second of the directions of the reciprocal movement, the p types of droplets other than the specific type of droplets from the nozzles of each of the (p−1) nozzle groups that do not eject the specific type of droplets, wherein third nozzles and forth nozzles of the plurality of nozzles eject the specific type of droplets, the third nozzles being in the first nozzle row and in a first nozzle group of the (p−1) nozzle groups in the conveying direction, the forth nozzles being in the second nozzle row and in a second to (p−1)-th nozzle groups of the (p−1) nozzle groups in the conveying direction.

10. An image forming apparatus comprising:

a recording head having a first nozzle row and a second nozzle row that are adjacent to each other in a direction perpendicular to a conveying direction of a recording medium, a plurality of nozzles being arrayed in the conveying direction in each of the first nozzle row and the second nozzle row, each of the nozzles ejecting one of p types of droplets including a predetermined specific type of droplets, where p is an integer equal to or greater than three;

a moving unit that relatively reciprocates the recording medium and the recording head in a direction perpendicular to the conveying direction; and a control unit that controls ejection of the p types of droplets from the nozzles, wherein the plurality of nozzles in each of the first nozzle row and the second nozzle row, respectively, are divided into (p−1) nozzle groups in the conveying direction, first nozzles of nozzles in a k-th nozzle group ($1 \leq k \leq p-1$) in the conveying direction and in the first nozzle row ejects the specific type of droplets, and second nozzles of the nozzles in the k-th nozzle group in the conveying direction and in the second nozzle row ejects one of the p types of droplets other than the specific type of droplets, nozzles of each of the (p−1) nozzle groups that do not eject the specific type of droplets eject a different one of the p types of droplets other than the specific type of droplets, nozzles of a first of the (p−1) nozzle groups ejecting the specific type of droplets at first in the conveying direction and nozzles of a second of the (p−1) nozzle groups ejecting the specific type of droplets at second in the conveying direction belong to different nozzle rows, the control unit controls to eject, in a first of directions of the reciprocal movement, the p types of droplets other than the specific type of droplets from the nozzles of each of the (p−1) nozzle groups that do not eject the specific type of droplets, the specific type of droplets from the nozzles of the first of the (p−1) nozzle groups ejecting the specific type of droplets at first in the conveying direction and from the nozzles of the second of the (p−1)

nozzle groups ejecting the specific type of droplets at second in the conveying direction, the control unit controls to eject, in a second of the directions of the reciprocal movement, the p types of droplets other than the specific type of droplets from the nozzles of each of the (p−1) nozzle groups that do not eject the specific type of droplets, and nozzles of odd-numbered nozzle groups of the (p−1) nozzle groups in the first nozzle row in the conveying direction and nozzles of even-numbered nozzle groups of the (p−1) nozzle groups in the second nozzle row in the conveying direction eject the specific type of droplets.

* * * * *